US012722746B2

(12) United States Patent
Ingram

(10) Patent No.: US 12,722,746 B2
(45) Date of Patent: Sep. 1, 2026

(54) AUTOMATIC SUBMERSIBLE WATER SPORTS COURSE SYSTEM

(71) Applicant: Samuel Ingram, Pompano Beach, FL (US)

(72) Inventor: Samuel Ingram, Pompano Beach, FL (US)

( * ) Notice: Subject to any disclaimer, the term of this patent is extended or adjusted under 35 U.S.C. 154(b) by 309 days.

(21) Appl. No.: 18/624,801

(22) Filed: Apr. 2, 2024

(65) Prior Publication Data

US 2025/0304216 A1 Oct. 2, 2025

(51) Int. Cl.

| | |
|---|---|
| ***B63B 22/18*** | (2006.01) |
| ***A63C 19/00*** | (2006.01) |
| ***B63B 22/04*** | (2006.01) |
| ***B63B 22/16*** | (2006.01) |

(52) U.S. Cl.

CPC ..... *B63B 22/18* (2013.01); *A63C 19/00* (2013.01); *B63B 22/04* (2013.01); *B63B 22/16* (2013.01); *B63B 2205/00* (2013.01)

(58) Field of Classification Search

CPC ..... B63B 22/18; B63B 22/00; B63B 22/16; B63B 22/22; B63B 22/24; B63B 22/28; B63B 22/20; B63B 2205/08; B63B 2207/00; B63B 21/26; B63B 21/24; B63B 22/04; F16L 37/40; A63C 19/00

USPC ..... 441/7, 6, 29, 30, 23, 2

See application file for complete search history.

(56) References Cited

U.S. PATENT DOCUMENTS

| | | | | | |
|---|---|---|---|---|---|
| 1,836,495 | A | * | 12/1931 | Paulson | B64D 25/20 116/210 |
| 2,619,303 | A | * | 11/1952 | Martin | B64D 25/20 441/20 |
| 3,020,669 | A | * | 2/1962 | Beyer-Olsen | A01K 75/04 264/304 |
| 3,680,160 | A | * | 8/1972 | Heikki | B63B 22/06 441/29 |

(Continued)

FOREIGN PATENT DOCUMENTS

| | | | | | |
|---|---|---|---|---|---|
| CN | 104838070 | A | * | 8/2015 | B32B 5/22 |
| JP | 2000213670 | A | * | 8/2000 | |

OTHER PUBLICATIONS

CN-104838070-A text (Year: 2015).*
JP-2000213670-A text (Year: 2000).*

*Primary Examiner* — Lars A Olson
*Assistant Examiner* — Eric Anthony Starck
(74) *Attorney, Agent, or Firm* — Karen Tang-Wai Sutton

(57) ABSTRACT

The invention described herein relates to an automatic submersible water sports course system comprising expandable buoys interconnected within an anchored network of non-buoyant airlines, operated by an air control system featuring a vacuum pressure pump. The vacuum pressure pump is capable of both collapsing and sinking the buoys below the water surface or expanding and raising them to the water surface. When deployed these buoys have a predetermined shape, size, height, and softness. This configuration offers skiers a consistent and precise water sports course, thereby reducing falls and enhancing safety. One embodiment of the present invention comprises airline which is configured for strength and forms a tensioned hose network used to precisely orient buoys at the water surface. The present invention provides a water sports course which is (Continued)

lighter weight, has fewer parts, and can be easily lifted above the water surface for maintenance and repair.

9 Claims, 16 Drawing Sheets

(56) References Cited

U.S. PATENT DOCUMENTS

| | | | | |
|---|---|---|---|---|
| 3,878,576 | A * | 4/1975 | Suyderhoud | B63B 22/16<br>441/6 |
| 5,516,317 | A * | 5/1996 | Moody | B63B 22/22<br>441/2 |
| 5,551,901 | A * | 9/1996 | Jaeger | B63B 22/16<br>441/6 |
| 7,303,453 | B1 * | 12/2007 | Bourke | B63B 22/22<br>441/6 |
| 7,455,561 | B1 * | 11/2008 | Tuttle | B63B 22/16<br>441/6 |
| 2004/0084107 | A1 * | 5/2004 | Guest | F16L 37/0985<br>141/346 |
| 2010/0087110 | A1 * | 4/2010 | Berg | A63C 19/00<br>441/6 |

* cited by examiner

AUTOMATIC SUBMERSIBLE WATER SPORTS COURSE SYSTEM

BACKGROUND OF THE INVENTION

Many competition water sports events require courses made up of buoys which are tethered to the lake bottom using anchors, stakes, or underwater wire and rigid beam assemblies. The buoys are flotation members constructed to designate a particular location on a body of water. Conventional water sports buoys are inflated members filled with compressed air to create sufficient buoyancy. The weight applied to the buoy causes a sinking gravitational force which is balanced by the buoyancy properties of the compressed air within the buoy. The balance between the weight and buoyancy result in the buoy to float partially above the water, hence, providing for visual designation of a precise location on a water surface. These water sports courses may require a plurality of buoys spread over large areas and in precise patterns to provide the necessary markers for the event. In particular, a slalom water ski competition course is approximately a quarter of a mile long by seventy five feet wide, and may display as many as thirty two buoys to designate the skier tow boat path and skier turns. Each of the slalom course buoys are required to be spaced and aligned to specific tightly toleranced dimensions relative to one another. The slalom course buoys are required to be a specific size, shape, color, and height above the water surface, and must be made of lightweight pliable material to avoid injury to skiers and damage to boats during impacts. Slalom course buoys must be able to break away and detach from tethers when boats, tow ropes, or skiers become entangled. All of these requirements make placing and maintaining water sports courses challenging considering the underwater operating environment where access is limited to swimming, diving, and boating platforms which are subject to the vagaries of wind, waves, currents and other boating activity.

Many water sports course systems have a need to remove or submerge buoys for various reasons when the course is not in use. Public waterway authorities may enforce strict rules limiting times when courses may be used and also require the buoys to be out of sight during non-use times. Time limitations provide the opportunity for others to enjoy the waterway for alternate activities, such as, fishing and sailing and result in improved harmony between lake users. Another reason to remove buoys is where waterways are crowded with boat traffic and it becomes impractical to keep buoys floating because the frequent boating activity may strike the buoys causing them to sink, or buoys are knocked off tethers and lost, or boats become entangled in the buoy tethering apparatus leading to safety concerns. Another reason to remove buoys is for applications where the water sports course system may be used infrequently and having the buoys removed or underwater provides protection from ice, or sun, or constant wave action so that the buoy colors stay brighter for improved visibility and the buoy material degrades less and provides for increased longevity. Yet another reason to remove or submerge buoys is where the same lake area is used for multiple water sports events and buoys in one event need to be removed or submerged while other events take place. Often water is cold and it is not practical or safe to spend any significant length of time in the water to set or remove water sports course buoys. In busy waterways it can be dangerous to be swimming or diving in the same area as recreational boats. Reattaching or resurfacing buoys is very time consuming and requires a lot of exertion that could be better spent on the enjoyment of the sport.

Water sports courses require frequent maintenance and repair especially when located in busy public waterways. Even if buoys are removed or submerged the remaining course system may be subject to damage, dislocation, or even removal by other lake users. Slalom course systems often become tangled in fishermen anchors or lures, are then pulled near to the lake surface, and the fishermen must remove the tangle often by cutting or breaking course components. Similar events happen when recreational boaters deploy anchors while drifting in the wind and unintentionally hook course components resulting in damage when anchors are forcibly lifted to the surface often breaking intricate courses into separate pieces. The marine environment is generally stressful on water sports course equipment both from corrosion of materials and constant dynamic forces on components caused by waves and currents. Metal parts may corrode and eventually fall apart and plastic parts may become brittle with age and break away. Inflated buoys produce constant buoyancy forces resulting in stress which causes buoys to develop leaks and also results in wear to tethers leading to periodic replacements. Submerged buoys may become discolored by aquatic growth and need to be scrubbed or replaced so they remain visible during use. Over time the submerged course components become covered in filth which is a nuisance for boat owners involved in maintenance and repair. The number of items that require maintenance and repair can be overwhelming for course operators. A slalom water ski course with thirty two buoys may have the same number of tethers, anchors, and hooks which results in one hundred and twenty eight components requiring routine maintenance. The required maintenance and repair often involve repeatedly lifting buoys attached to heavy anchors resulting in lower back injuries and tendinitis to elbows and shoulders. For all of these reasons water sports courses, especially in public waterways, tend to fall into disrepair, require large investments of time and effort to maintain and repair, and therefore easily become partially or fully inoperable.

Water ski competitors can achieve speeds approaching sixty miles per hour while attempting to ski as close as possible to buoys. It is common that skiers forcefully impact the buoys with skis and or body and it's important that the buoys are sized and placed consistently and correctly to help prevent injuries. It's common for water sports courses to have buoys that are larger or smaller than they need to be, buoys that are floating higher or lower than they need to be, or buoys that are firmer than they need to be. Any of these adverse buoy conditions can cause a skier to be unexpectedly knocked down at high speeds resulting in broken ankles, dislocated shoulders, concussions, and the like. Buoys are typically made of an elastomeric vinyl material and are inflated with air using an inflation needle until they become correctly sized for the water sports event. However, once buoys are placed in service, they may constantly change size based on fluctuations of water temperature, air temperature, changes to the vinyl elasticity over time, natural air loss, or air seeping from faulty buoy needle inflation valves. Buoys that are submerged for long periods lose air as a result of being under constant and higher underwater pressures and they become smaller. Submerged buoys also then tend to become more firm than desired when they are inflated back to proper size. Buoys can also get larger as a result of water and or air becoming warmer resulting in more buoyancy and the buoys then tend to float higher, and when the water or air becomes cooler buoys get smaller lose buoyancy and often will become partially or even fully submerged. Many bodies of water have lake levels which fluctuate and may cause the height of the buoy above the water surface to be higher or lower than is desirable. As a result of all these factors, buoys require constant monitoring and adjustment for size, height above the water surface, and firmness which is very time consuming and requires a lot of exertion that could be better spent on the enjoyment of the sport. Buoy size adjustments are often hindered by inflation valve leaks generated by frequent inflation needle insertions which tend to damage the buoy inflation valves and buoys must be discarded and replaced. Sometimes the buoy inflation valves require high force to insert the inflation needles which further increases the difficulty in correctly sizing and placing buoys. Therefore, water sports courses commonly have buoys which are out of adjustment and dangerous for skiers which results in water skier injuries.

The following patent references describe various prior art that may be related to the above described water sports course systems:

Suyderhoud, U.S. Pat. No. 3,878,576, issued on Apr. 22, 1975, discloses a water ski slalom course having buoys which utilize a single anchored cable to which the buoys are affixed by perpendicular cross arms. The cable and rigid cross arms are suspended about five feet below the water surface by ropes leading up to and tied to the course buoys which are floating on the surface of the water. The entire system is secured to the lake bed by a heavy anchor on each end. This system was originally made by Accufloat and has been on the market for over forty years. Portable versions of the Accurfloat system have also been manufactured featuring collapsible beam components allowing for more ease in transport to different waterway locations. Removal of the water sports buoys in this system allows the rest of the water sports course to submerge to the lake bed when not in use, but this has the disadvantage of taking considerable time and strenuous effort to reattach buoys to put the course back into operation. In order to reattach the buoys, the course mainline cable and rigid cross beams need to be pulled near the water surface and the participants must be vigilant that boat propellers and or the swimmers do not become entangled in the course equipment leading to injuries to swimmers or damages to the course. Another shortcoming with this system is that often the mainline cable is a very small diameter wire rope with many crimp connections. The wire rope or crimp attachments are often broken if the course is snagged and pulled on by course operators or other lake users. Corrosion over time also reduces the strength of the cable and crimp connections resulting in increased likelihood of breakage. When the mainline cable is broken it is difficult to find the detached course sections, difficult to pull the two course sections back together, and difficult to repair or replace the broken cable. Furthermore, the buoys which are attached to these suspended course systems have the common problem of being out of adjustment for size, height, and firmness which may lead to skier injuries.

Moody, U.S. Pat. No. 5,516,317, issued May 14, 1996, discloses a system to sink and float buoys using a submarine device consisting of a hard plastic canister with sand to provide ballast weight in the bottom half, and a rubber air bladder to provide buoyancy in the top half. Water sports buoys are tied to and float above the top of the submarine. By inflating the air bladder the water sports buoy and submarine together have enough buoyancy to float up to where the buoy is displayed on the surface of the water. Conversely, when the air bladder is deflated the water sports buoy and submarine lose buoyancy and may submerge to where the submarine and buoy sit on the lake bottom. One embodiment of the submarine system is disclosed where a plurality of submarines are tied to a suspended water ski slalom course such as the Accufloat. A network of polyethylene tubing is zip tied to the cables and cross beams of the suspended course and interconnects all the submarine bladders. A compressor is located on shore and connected to the course using a long feedline of polyethylene tubing. Ballast bricks are zip tied periodically to the polyethylene tubing on the course and also the tubing leading to the compressor which prevent tubing from floating up near to the water surface and becoming tangled and damaged by boating activity. This embodiment of the submarine system was originally made by Accusink and was on the market for several years. The Accusink submarine system saved a lot of time and a huge amount of effort by automating the raising and lowering of water sports buoys resulting in more time to enjoy the sport of slalom skiing. Running the compressor about ten minutes inflated the air bladders and raised the slalom course. Sinking the course was accomplished by a simple turn of an air valve on shore which vented the tubing network to atmospheric conditions causing the air bladders to slowly collapse in about fifteen minutes. One of the problems with this system was a susceptibility to become inoperable if any water infiltrated the airlines and bladders. Inevitably, over time water entered air lines and bladders by condensation, small leaks occurring in the air lines or bladders, or tubing fittings coming apart. In this degraded condition the system would not reliably sink or float. The process for getting the system working again often consumed hours of time and involved finding air leaks, fixing air leaks, blowing water out of air lines, and manipulating submarines to remove water from the bladders. The weight of each submarine being approximately forty five pounds presented difficulties for lifting them onto boat swim platforms in order to remove water from the bladders. Furthermore, when located in deep water and trying to lift an entire cross beam assembly having multiple submarines, the task became unmanageable for course operators. Additional problems caused by the heaviness of the submarine system was a high likelihood of course damages resulting from entanglements. When this water sports course system is setting out of use on the lake bottom it cannot be easily pulled to the surface, therefore, the entire network of cabling, tubing, and cross beams may be ripped into pieces during an entanglement. Once the course has incurred damage the heaviness of the submarines makes repairs extremely difficult. Another disadvantage of the Accusink submarine system is the large number of parts requiring maintenance and repair which becomes overwhelming to course operators. The tubing, tubing fittings, hose clamps, bricks, zip ties, submarine canisters, sand, and air bladders result in hundreds of parts subject to damage and needing routine maintenance and repair. The failure of any part would often cause the system to be inoperable, subject the system to additional damage, and require extensive effort and time to resolve. Another problem with this submarine system were buoyancy variations between submarines causing a need for the water sports buoys to be inflated to different sizes. These variations in buoy size, height out of the water, and firmness subjected skiers to unexpected falls leading to serious injuries.

Tuttle, U.S. Pat. No. 7,455,561 B1, issued Nov. 25, 2008, discloses an improved system to sink and float buoys which overcomes disadvantages described in the Moody U.S. Pat. No. 5,516,317 patent. What is disclosed is a system for sinking and floating buoys that separates the ballast weight component from the air bladder component in order to better facilitate maintenance and repairs of the system and water sports course to which it is attached. In this system the water sports buoys are tied to and float above the top of the air bladder, while the sand ballast weight component is tethered separately below the air bladder. By inflating the air bladder, the water sports buoy and ballast weight component have enough buoyancy to float up to where the buoy is displayed on the water surface. Conversely, when the air bladder becomes deflated the water sports buoy and weight component lose buoyancy and then submerge to where the weight component and water sports buoy sit on the lake bottom. In one embodiment, this system is described to be directed to a plurality of water sports buoys connected to a submerged cable and cross beam network forming a water sports course. This system is known as the WallyCourse, and is a product offered by WallySkier. Furthermore, to provide the functionality to sink and float the water sports course buoys, tubing may be lashed to the cable and crossbeam network and interconnected to a plurality of air bladders. This additional system is known as the WallySinker, and is a product also offered by WallySkier. An air pump or compressor with an optional pressure gauge is used to supply the pressurized air to inflate the individual air bladders. In order to submerge the buoys, air is removed from the network of tubing and air bladders using an air pump or by opening a valve to allow air to escape, and thereby, reducing buoyancy at the individual bladder and buoy locations. Small ballast weights are lashed periodically to the tubing and cable network to prevent the tubing and cable from floating up towards the lake surface and becoming tangled and damaged by boating activity. The resulting system is described to provide for improved repair and maintenance tasks. One provided improvement is modularity where each cable, airline, bladder, ballast, and crossbeam component of the system is easily replaceable without the need for hand tools. Another improvement is the advantage of the separate location of the weight component below the cable, tubing, cross beam, air bladder, and buoy network. This improvement allows for the majority of repair and maintenance tasks to be more easily performed without the need to lift the heavy weight components onto the swim platform. One further aspect of the invention is a described measuring tool for verifying buoys are inflated to the proper diameter. There are several disadvantages in the design of the system described in the U.S. Pat. No. 7,455,561. First, when the invention is directed for use in public waterways and while in a submerged and inactive condition, it is very susceptible to entanglement by anchors, fishing lures, ski ropes, boat propellers and the like as a result of the cross beams, cables, and tubing networks being suspended above the lake bottom. During an entanglement, the weight components consistently force the system to stay down on the lake bed. Therefore, an entangled system often is required to be forcibly pulled loose or cut away, and often results in extensive damage to the cables, tubing, bladders, and crossbeams. The modular aspect of the system is helpful for repairs, however, the susceptibility towards entanglements and the time and effort required to replace damaged components is detrimental to the enjoyment of the sport. Another disadvantage of the invention is simply the large quantity of components located at each water sports buoy location and also involved in building out the network of cables, tubing, and cross beams all requiring monitoring for repair and maintenance which is very difficult and time consuming for course operators. The failure of any of the dozens of components often leads to an inoperable system which will not reliably sink or float buoys and requires considerable time and effort to repair. Still further, this system for sinking and floating buoys has the common issue of the water sports buoys becoming out of adjustment over time for diameter, height above the water surface, and firmness which may lead to skier injuries. The water sports buoy inflation may also require adjustment to allow for small variations in air bladder size or small variation in the actual weight of ballast components.

Berg, U.S. Pat. Application Publication No. US2010/0087110 A1, discloses a portable automatic deploying slalom water ski course using the global positioning system (GPS) to position buoys. A collection of six "turn ball spans" and two "entry/exit gate spans" contain GPS receivers, propulsion devises, and computer controls to maintain buoy positions while in use. The water ski course is deployed from a boat, dock, or other deployment point and can be activated to return to the deployment point once a ski session is complete. A GPS based water sports course does not require anchors, cables, complex rigging, and the like to form the course, thereby, saving time and being less cumbersome than conventional anchored submersible installations. At this time GPS based water sports courses have not been fully developed for commercial distribution. However, if and when they become commercially available, the system would have advantages over permanent submersible anchored installations. One advantage of these portable systems is they are more likely to be allowed on public water ways because they can be completely removed following use as compared to conventional anchored submersible installations. Another advantage is portable systems are not exposed to damage from other lake users once removed and remotely stored. Additionally, another advantage is a portable system may receive repair and maintenance during non-use times while stowed. For all these advantages, a GPS based portable slalom course system has several disadvantages. The GPS invention described herein requires multiple buoys, turn arm spans, and gate arm spans which would result in considerable handling time requirements for deployment. Likewise, transporting buoys, turn arms, gate arms, and the like is cumbersome especially in a space constrained boat. Another disadvantage of portable electronics, such as this GPS based system, is the need for consistent battery power. Slalom water ski outings may often last hours and the GPS receivers, propulsion devices, and computer controls would put high demand on battery power and also require the associated battery charging equipment.

Therefore, there is a need in the industry for an improved automatic submersible water sports course system that addresses the shortcomings described above. What is desired are safer water sports buoys that consistently maintain the correct size, height out of the water, and softness irrespective of variables such as time, water temperature, air temperature, and other factors. Additionally, what is desired is a lighter weight more manageable system which has fewer parts, is less susceptible to damage, and thereby is easier to lift, maintain, and repair. Furthermore, what is desired is a system which is naturally non-buoyant while stowed and unable to rise unintentionally above the lake bottom or to the water surface and become susceptible to damage. Still further, what is desired is a reliable system that may be swiftly deployed and stowed leaving more time for enjoyment of water skiing.

SUMMARY OF THE INVENTION

The Invention generally relates to the field of water sports and buoys. All embodiments of the invention include one or more hose tethered buoys interconnected to an air control. The hose tethered buoys are constructed using a soft and pliable fiber-wound elastomeric buoy, which is pierced and fused to a slim and flexible fiber-braided elastomeric hose. The hose serves as both a long tether attachment and an airline connection to the buoy. An inline valved breakaway coupling may be inserted into the hose tether below a buoy to provide for entanglement safety release, buoy removal or replacement, and prevention of water entry into airlines. The buoys when expanded and deployed to the water surface may have a predetermined color, shape, size, height, and softness. This configuration offers skiers a consistent and precise water sports buoy, thereby reducing falls and enhancing safety. The air control may be located on shore, or dock, or similar structure and may be interconnected to a hose tethered buoy by a supply line. The air control includes a vacuum pressure pump that is capable of both collapsing and sinking the buoys below the water surface or expanding and raising them to the water surface. Once the hose tethered buoys are either submerged or raised the pump may be turned off and disconnected from the source airline.

One embodiment of the present invention relates to an automatic submersible water ski course using a discrete anchor system. In this system each hose tethered buoy is tethered to a discrete base member which may be fixed to the lake bottom. Non-buoyant hose segments may be daisy-chained from base member to base member along the lake bottom. Hose fittings may be used at each base member to interconnect the non-buoyant hose segments and hose tethered buoys. A non-buoyant supply line may be routed from the air control on shore, along the lake bottom, and interconnected to a hose fitting on one of the base members, hence, forming a sealed airline network completing the discrete anchor system.

A second embodiment of the present invention relates to an automatic submersible water ski course using a suspended tension system. A conventional suspended tension system typically utilizes a long, small-diameter wire rope anchored or staked at each end to the lake bottom. This second embodiment of the present invention is directed to a suspended tension system, however, where the conventional suspended tension system typically utilizes wire rope, the present invention eliminates the wire rope and instead utilizes non-buoyant toughened hose. The non-buoyant toughened hose may be anchored or staked at each end to the lake bottom and tensioned to ensure straight alignment between the anchors. Periodically hose tethered buoys may be interconnected to the non-buoyant toughened hose, elevating the hose above the lake bottom, and suspending the hose below the water surface, therein, providing for precise alignment and position of the hose tethered buoys between the anchors. A suspended tension water sports course may be configured in multiple ways, such as, slalom ski course, trick ski course, jet ski course, swim area marker, and the like, with the basic variance being the number and spacing of the buoys. This second embodiment of the present invention is further directed to a slalom ski course, but not limited as such. A slalom water ski course is lengthy being approximately a quarter mile long by seventy-five feet wide, and displays up to thirty-two precisely located water sports buoys to designate the skier tow boat path and skier turn path. The non-buoyant toughened hose may be configured similarly anchored or staked at each end to the lake bottom and tensioned providing straight alignment of the hose between the anchors. The tension hose network may then periodically include precisely spaced diamond shaped transition areas along the length of the course using hose fittings and short wye segments of toughened non-buoyant hose. Rigid non-buoyant beams may be coupled to the center of the diamond shaped transitions in a perpendicular orientation to the course centerline. Hose tethered buoys may be joined to the beams and interconnected to the non-buoyant tension hose network, therein providing precise alignment and position of all the buoys required to designate the slalom water ski course. A non-buoyant supply line may be routed from the air control on shore, along the lake bottom, and interconnected to the tension hose network, hence, forming a sealed airline network completing the suspended tension system. When the course is out of use and submerged, the tension hose network, beams, and collapsed buoys all sink and may set adjacent to the lake bottom safely away from boat propellers and other public lake activities.

Embodiments of the present invention represent a significant advance in the field of automatic submersible water sports course systems. Conventional automatic submersible water sports course systems utilize conventional, cord tethered, pressurized, water sports buoys that constantly change size and buoyancy as a result of air loss, temperature changes, and submersion pressures. In contrast, embodiments of the present invention use airline tethered, collapsible buoys which when inflated have a predetermined size that remains constant regardless of variations in the operating conditions. This novel integration of an airline tether fused to a collapsible buoy of predetermined size enables improved skier safety and system reliability by ensuring buoys are always the right size, floating at the right height, and soft. Conventional automatic course systems utilize weight components, air bladders, tubing networks, and cable networks. In contrast, embodiments of the present invention utilize a single tubing network. This novel removal of weight components, air bladders, and an entire cable network enables easier system repair and maintenance by providing an extremely light, thereby, more manageable course having significantly fewer parts. A lighter more manageable course also enables easier disentanglement from transient anchors and fishing lures, which reduces the probability of the course sustaining damage. Conventional automatic slalom course systems utilize lightweight and buoyant airlines that must be secured through installation and periodic inspection of over four hundred ties that may fail with age or become dislodged by entanglements, hence, the airline may float up toward the water surface and become wrapped in boat propellers or the like. In contrast, embodiments of the present invention use toughened non-buoyant airline that does not require additional weights and ties. This novel application of a toughened non-buoyant airline enables improved system ease of use and reliability by eliminating hundreds of failure prone ties, eliminating the possibility of the airline floating to the surface, and reducing the probability of airline damage from boat propellers, anchors, fish hooks, and the like.

Another difference of the present invention compared to previous art relates to the introduction of a dedicated vacuum pump in the system required to collapse and sink the buoys below the water surface. When the hose tethered buoys are expanded and floating at the water surface, and while having the air supply line vented to atmosphere, the hose tethered buoys will not sink below the water surface. The hose tethered buoys will remain floating at the water surface while vented and unpressurized. This is unlike the previous art where atmospheric venting of the air bladders located below the water surface would naturally collapse the air bladders and sink the system as a result of natural underwater pressure being applied to the exterior of the air bladder. The consequence of this difference has two parts. First, to sink the present invention, a vacuum pump must be interconnected and turned on until all of the hose tethered buoys are completely collapsed and submerged. Second, all of the airline used in the present invention must be configured to support both internal vacuum conditions, while at the same time being exposed to external water pressure present at the bottom of the lake. The airline used in previous art might collapse under these conditions, depending on the hose construction and water depth, and may lead to failure of the system to operate reliably.

The forementioned and other features and advantages of the present invention will be set forth or will become more fully understood in the following detailed description, appended claims, and appended drawings. For those skilled in the art, the features and advantages of the present invention will be obvious as described, for those less experienced, the features and advantages may be learned and recognized by the practicing of the invention as described herein.

The foregoing summary description and forthcoming detailed description are representative aspects and embodiments of the present invention and are provided as an outline for understanding the characteristics of the invention as it is claimed. The appended drawings comprise a part of the present invention and are provided for further understanding of the invention characteristics. Various embodiments of the present invention are depicted through the drawings and associated detailed description and provide the fundamental form, function, and operation of the invention, nonetheless, the included drawings and descriptions should not be construed as limiting.

DETAILED DESCRIPTION OF THE INVENTION

Reference is initially made to FIGS. 1-9 which illustrate various views of an automatic submersible water sports course discrete anchor system, designated generally at 100, and an air control, designated generally at 200.

Figure 1:
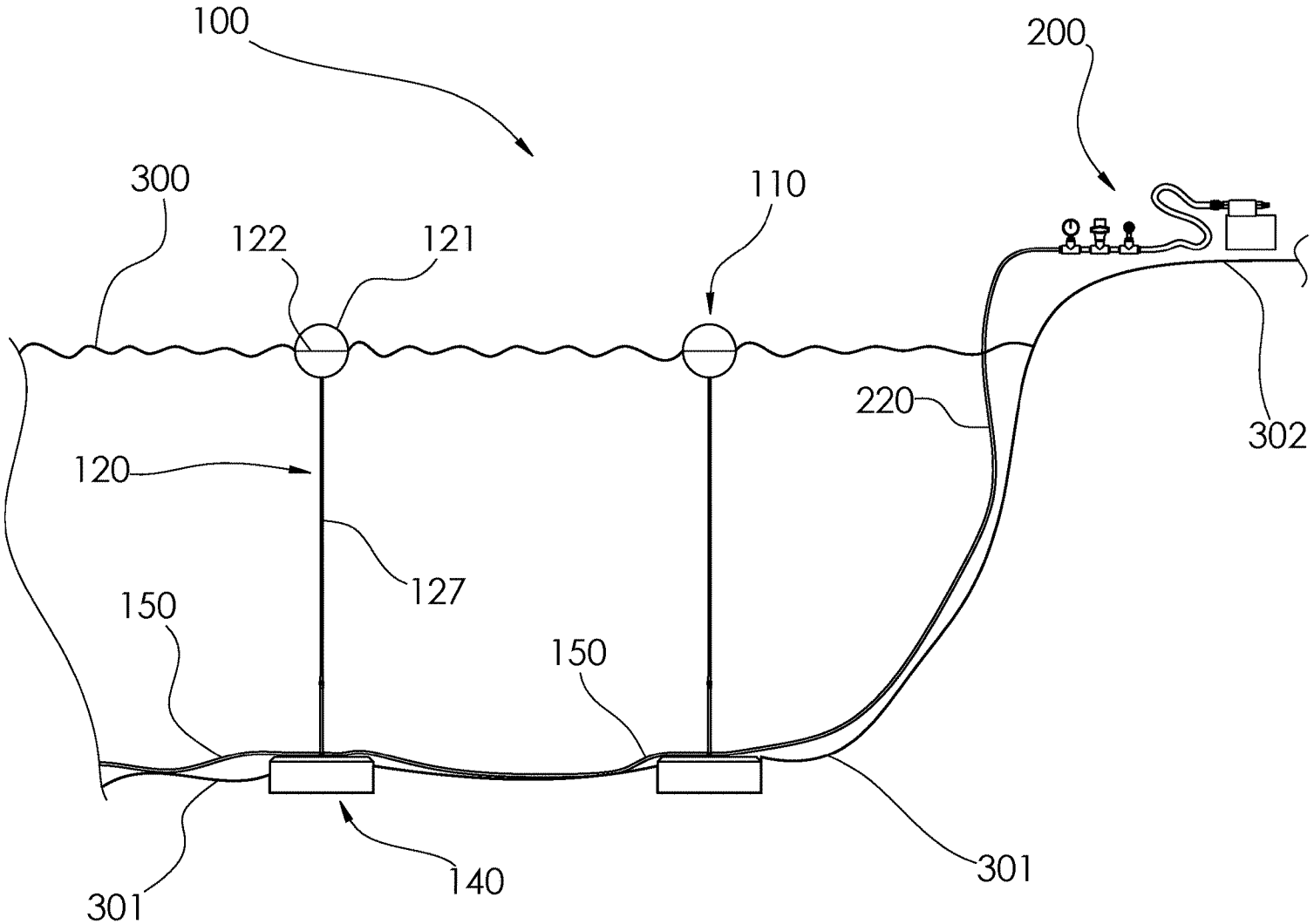
FIG. 1 is a side elevation view of an automatic submersible water sports course discrete anchor system according to an embodiment of the present invention.

As shown in FIG. 1, the air control 200 is located on the lake shore 302 or similar structure, such as a dock, raft, or boat. A non-buoyant supply line 220 is routed from the air control 200 along the lake bottom 301 and connected to a submersible marker 110. A plurality of submersible markers 110 are set on the lake bottom 301 and connected together using non-buoyant hose segments 150. Each submersible marker 110 has a base member 140 coupled to a hose tethered buoy 120. While in use, as shown, the expanded predetermined sized buoys 121 are deployed to the water surface 300. The hose tether 127 may be tensioned by a length adjustment to ensure a water-level hash mark 122, stenciled at the expanded predetermined sized buoy 121 midbody, coincides with the water surface 300. The coupling of the non-buoyant supply line 220, submersible markers 110, and the non-buoyant hose segments 150 forms a sealed airline network.

Figure 2:
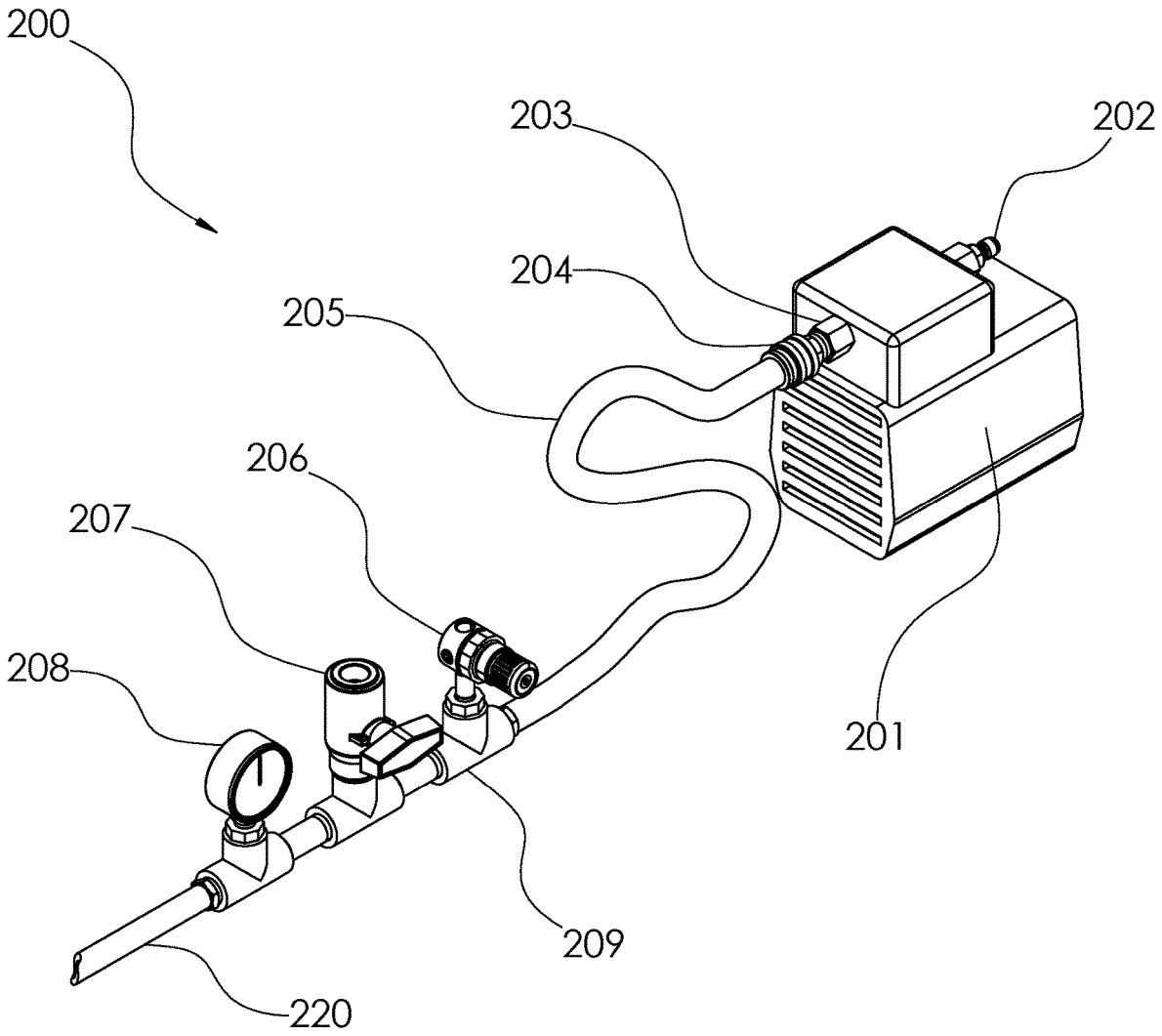
FIG. 2 is a perspective view of the air control shown in FIG. 1.

FIG. 2 shows the arrangement of the air control 200 that is used in all embodiments of the invention. A vacuum pressure pump 201 has an inlet port with a quick connect submerge plug 202 and an outlet port with a quick connect raise plug 203. A fiber-reinforced flexible rubber hose 205 with a quick connect socket 204 on one end is shown plugged into the quick-connect raise plug 203. The fiber-reinforced flexible rubber hose 205 can easily be switched by hand back and forth between the quick connect submerge plug 202 and the quick connect raise plug 203 using the quick-connect socket 204. The opposite end of the fiber-reinforced flexible rubber hose is connected to a manifold 209 with through ports as shown for a pressure regulator 206, relief valve 207, vacuum pressure gauge 208, and supply line 220 connected to the automatic submersible water sports course discrete anchor system 100.

Figure 3:
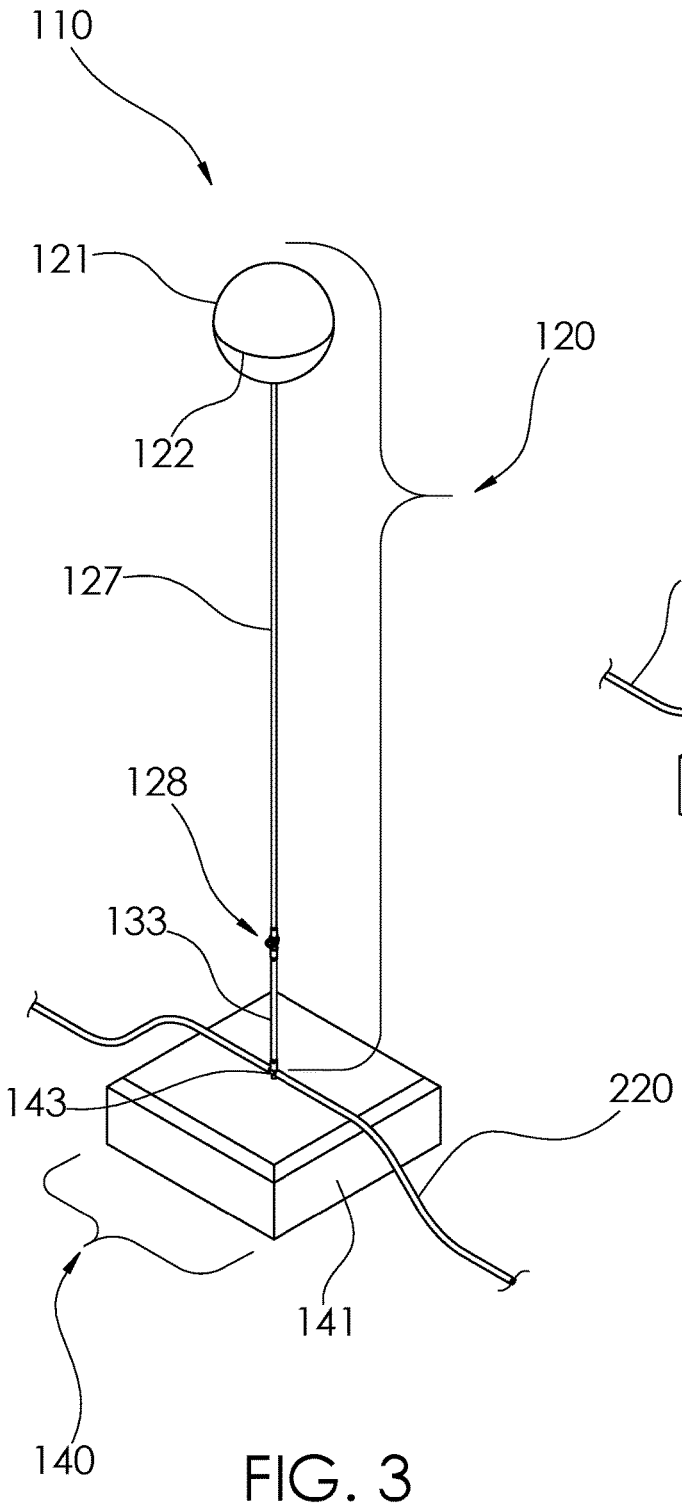
FIG. 3 is a perspective view of a submersible marker shown in FIG. 1.

The perspective detail view FIG. 3 shows the submersible marker 110 comprising two coupled assemblies, one being the hose-tethered buoy 120, and the other being the base member 140. An expanded predetermined size buoy 121 is shown at the top of the hose-tethered buoy 120 and is stenciled at the mid body with a water-level hash mark 122. Integral with and descending below the expanded predetermined size buoy 121 is a fiber-reinforced flexible rubber hose tether 127. Connected to the lower end of the hose tether 127 is a breakaway coupling 128, which is in-line with a fiber-reinforced flexible rubber coupling hose 133. The coupling hose 133 descends below the breakaway coupling 128 and connects to the base member 140 hose fitting 143. The hose fitting 143 is fastened to the base member 140 and interconnects the non-buoyant supply line 220, non-buoyant hose segments 150, and hose tethered buoy 120 together forming a sealed airline network.

Figure 4:
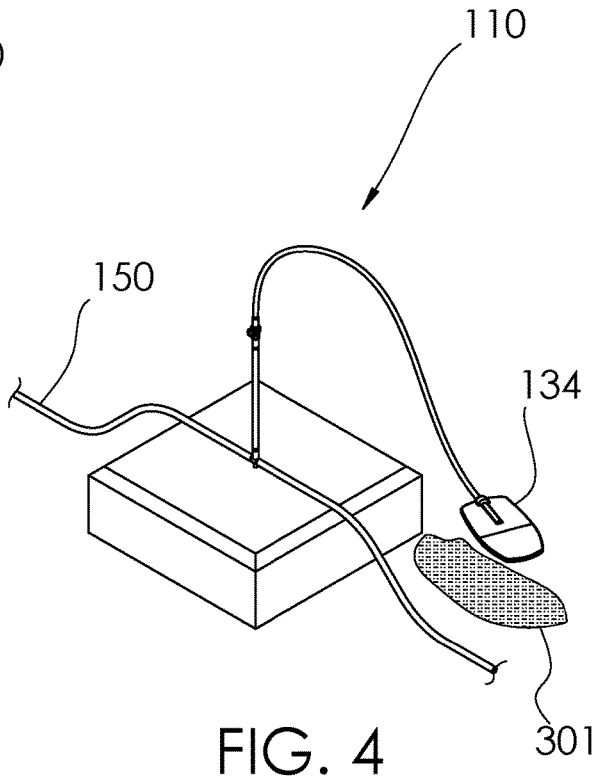
FIG. 4 is a perspective view of a submersible marker shown in FIG. 1 depicting a collapsed buoy resting on the lake bottom.

The perspective detail view FIG. 4 shows the transition between the in use expanded predetermined size buoy 121 detailed in FIG. 3 to the out of use condition. In the out of use condition the hose tethered buoy 120 has a collapsed buoy 134 resting on the lake bottom 301.

Figure 5:
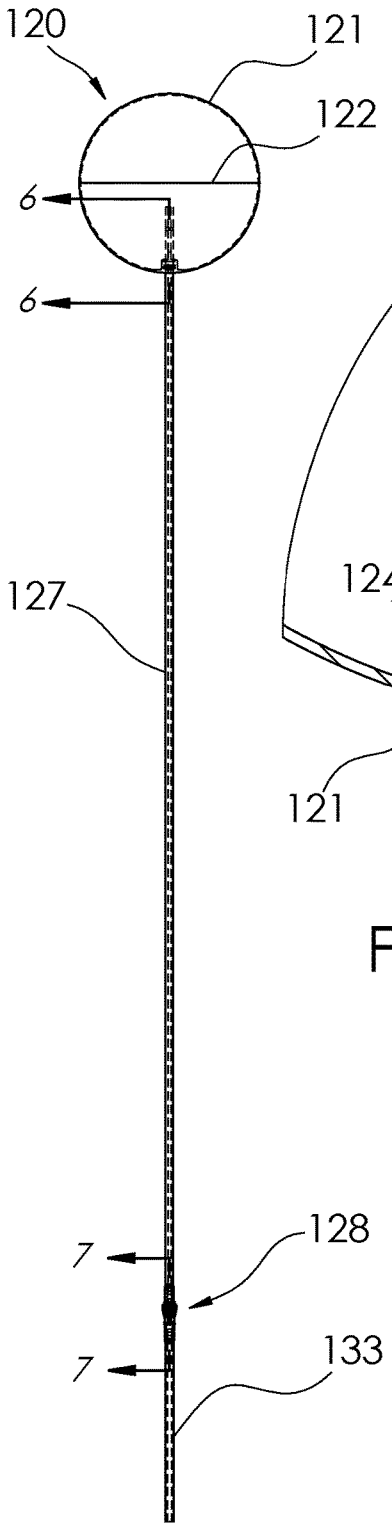
FIG. 5 is a side elevation view of the hose tethered buoy shown in FIG. 3.
Figure 6:
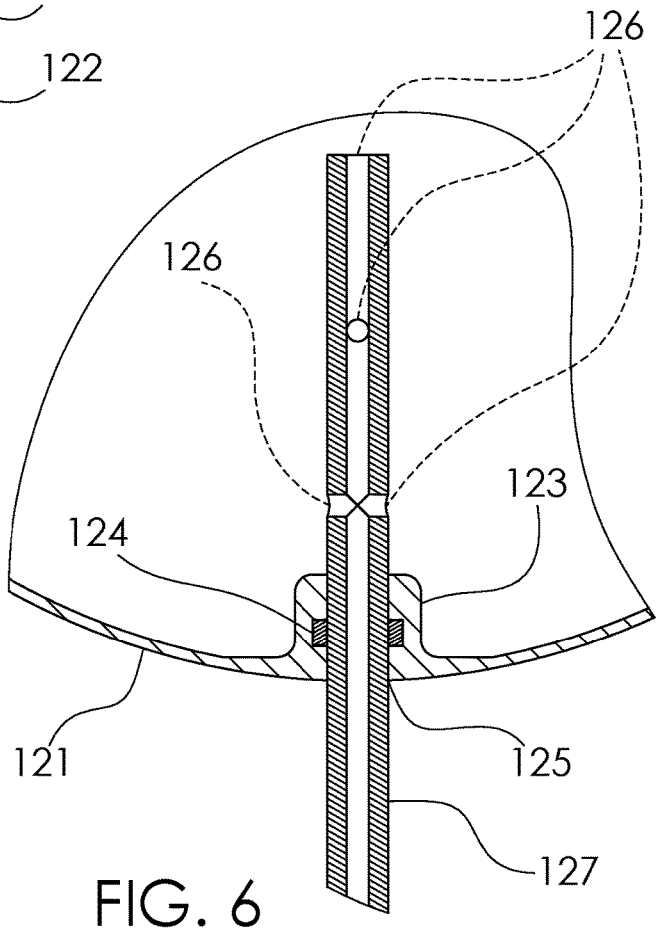
FIG. 6 is an enlarged section view of the hose tethered buoy taken along section line 6-6 of FIG. 5.
Figure 7:
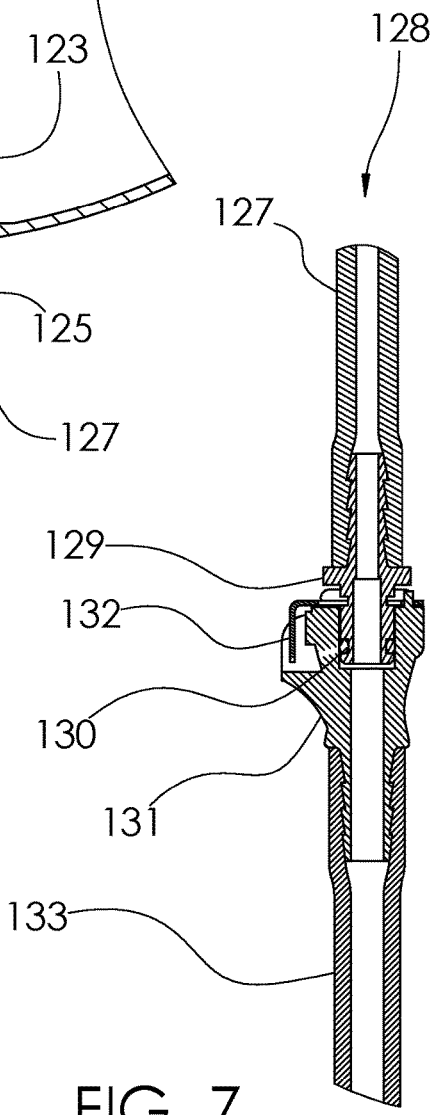
FIG. 7 is an enlarged section view of the hose tethered buoy breakaway coupling taken along section line 7-7 of FIG. 5.
Figure 8:
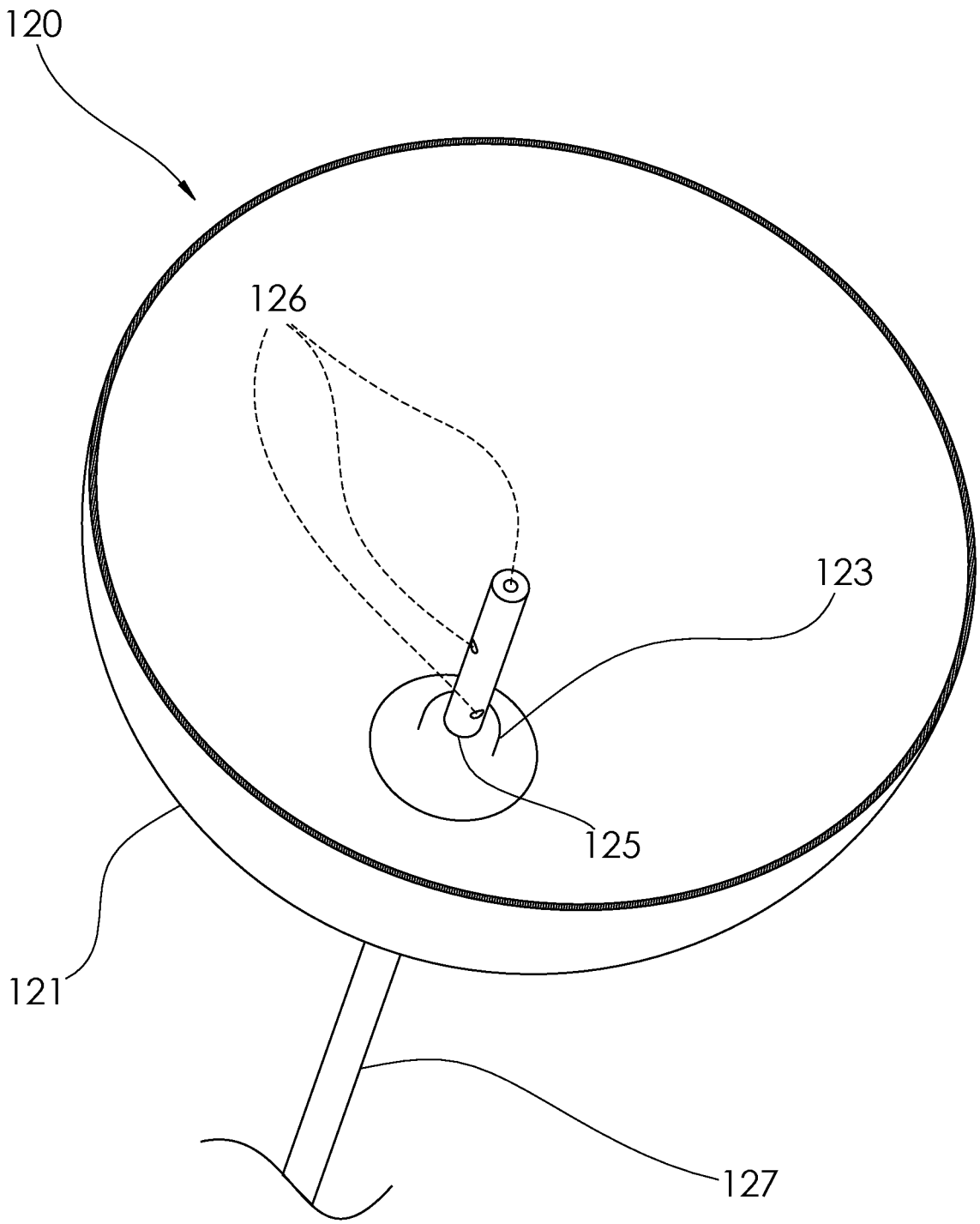
FIG. 8 is a perspective cut away view looking down inside the expanded predetermined size buoy shown in FIG. 5.

FIGS. 5-8 detail the hose-tethered buoy 120, which is common to all embodiments of the invention. FIG. 5 displays hidden interior dashed lines showing the extension of the upper end of the hose tether 127 into the interior of the expanded predetermined size buoy 121. The expanded predetermined size buoy 121 comprises an approximately one-sixteenth-inch-thick wall fiber-wound flexible rubber sphere providing for a specific outside diameter and a high-visibility exterior color, such as red or green. The hose tether 127 comprises a fiber-reinforced flexible rubber hose with an approximate inside diameter of one-eighth inch and outside diameter of eleven thirty-seconds of an inch. The FIG. 6 section view taken along line 6-6 of FIG. 5 details the arrangement of a body member 123, member passage 125, and rubber seal ring 124. The hose tether 127 extends approximately three inches into the expanded predetermined size buoy 121, piercing through the body member 123 member passage 125 and rubber seal ring 124. The upper end of the hose tether 127 contains multiple bleeder passages 126 to consistently achieve a collapsed buoy 134 condition when being submerged by the air control 200. The FIG. 7 section view taken along line 7-7 of FIG. 5 shows the breakaway coupling 128 inserted between the hose tether 127 and the coupling hose 133. The upper end of the plug 129 has a three-sixteenths inch hose barb inserted into the hose tether 127. The lower end of the plug 129 has a rubber o-ring seal 130 that easily slips into the valved socket 131. The valved socket 131 includes a thumb latch 132, which when actuated allows for easy removal and installation of the plug 129. Upon removal of the plug 129, the valved socket 131 valve automatically closes, preventing water passage into the coupling hose 133. The lower end of the valved socket may have a one-quarter-inch diameter hose barb inserted into the coupling hose 133. The plug 129 and valved socket 131 may be composed of rigid plastic. The coupling hose 133 may be composed of a fiber-reinforced flexible rubber hose approximately three-sixteenths inch inside diameter, three-eighths inch outside diameter, and ten inches long. The overall lengths of the hose tether 127 and coupling tether 133 may be variable. Alternate embodiments of the hose-tethered buoy 120 could include replacing the breakaway coupling 128 with a barbed straight reducer fitting, or as another embodiment, connect the hose tether 127 directly to the base member 140 eliminating both the breakaway coupling 128 and coupling hose 133. FIG. 8, showing a cutaway view of the interior of the hose tethered buoy 120, provides additional perspective on the arrangement of the bleeder passages 126, body member 123, and through passage 125. Hot vulcanization may be used to fuse the hose tether 127, body member 123, and seal ring 124 rubber components together forming a sealed, reinforced permanent coupling between the expanded predetermined size buoy 121 and the hose tether 127.

Figure 9:
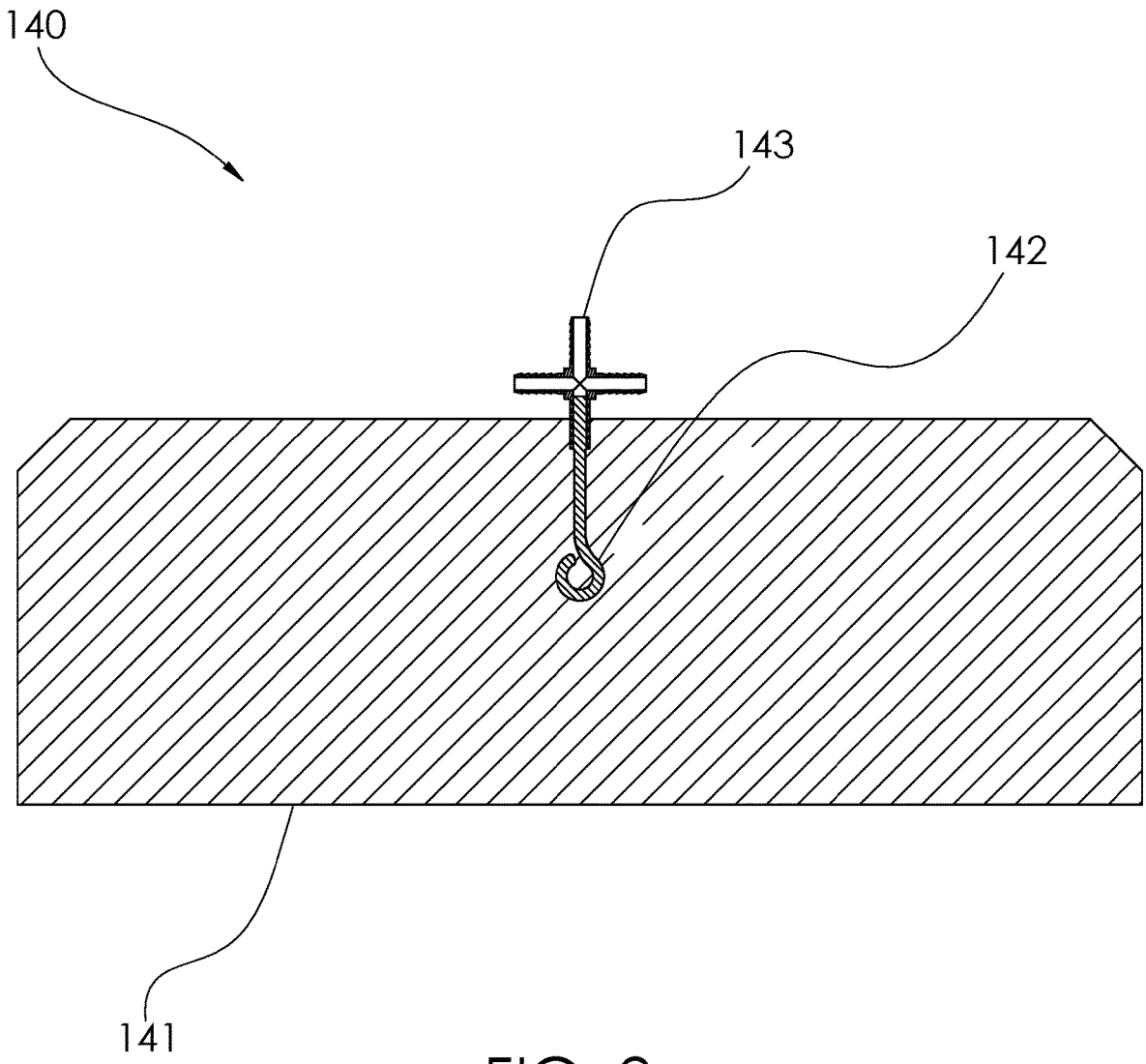
FIG. 9 is a cross section elevation view of the marker base shown in FIG. 3.

FIG. 9 is a cross section elevation view of the base member 140 component shown in FIG. 3. The base member 140 has ballast 141, a hose fitting 143, and a fastener 142. The fastener may be press-fit or bonded to the downward leg of the hose fitting 143. The fastener 142 may be embedded and cured into the ballast 141 as shown. Both the fastener 142 and hose fitting 143 may be composed of non-corrosive materials, such as stainless steel. The upward leg of the hose fitting may comprise a one-quarter-inch hose barb that may be linked to a coupling hose 133. The two horizontal legs of the hose fitting 143 may be comprised of one-quarter-inch diameter hose barbs and linked to a non-buoyant supply line 220 or non-buoyant hose segments 150 as shown in FIG. 3. Alternate embodiments of the base member 140 could include a metal stake screwed into the lake bottom 301, which would be a substitute for ballast 141. Another embodiment would be a lightweight base member 140 such that it may be raised above the lake bottom by the deployment of the hose tethered buoy 120. In this envisioned embodiment, the suspended lighter base member 140 may be positioned to the lake bottom 301 using various methods allowing for vertical movement of the submersible marker 110.

Reference is now made to FIGS. 10-24 which illustrate various views of an automatic submersible water sports course suspended tension system, designated generally at 500. Specifically, this system 500 is designed for use as a water ski slalom course. A water ski slalom course measures approximately one quarter of a mile in length and seventy-five feet in width. National and international governing bodies specify details regarding the placement and characteristics of boat and skier markers on the water surface. These markers are intended to be consistent in size, shape, color and relative orientation from one course to another. However, the underwater apparatus used at different slalom course locations often varies significantly, employing a diverse range of methodologies.

Figure 10:
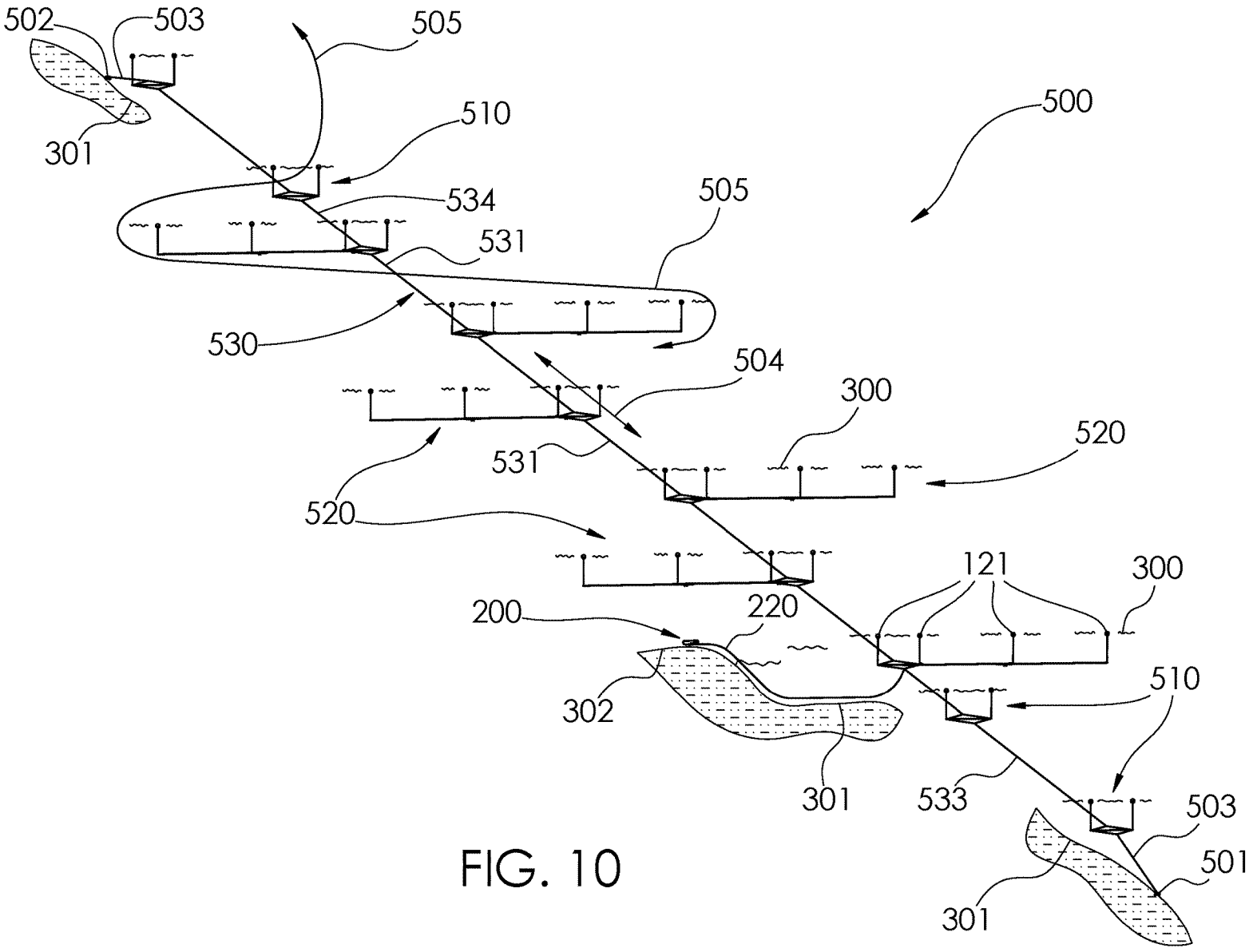
FIG. 10 is a perspective view of an automatic submersible water sports course suspended tension system according to an embodiment of the present invention.

FIG. 10 shows a perspective view of the automatic submersible water sports slalom course suspended tension system 500 in use. Anchor 501 on one end and anchor 502 on the other end are permanently set on the lake bottom 301 and intended to remain stationary. Stretched and tensioned between anchors 501 and 502 are ropes 503 and a non-buoyant tension network 530. Anchors 501 and 502 may be comprised of concrete blocks, standard boat anchors, metal stakes, or other non-buoyant materials. Rope 503 is preferably one-half or three-eighths inch diameter non-buoyant nylon construction, extending at approximately a twenty degree angle off the lake bottom 301, and tied in place at each end using knots. Details of the non-buoyant tension network 530 are provided in following descriptions and are illustrated in FIGS. 13-18. An air control 200, previously described, is located on the lake shore 302 or similar structure, such as a dock, raft, or boat. A non-buoyant supply line 220 is routed from the air control 200 along the lake bottom 301 and coupled to the non-buoyant tension network 530. At the water surface 300, are thirty-two expanded predetermined size buoys 121 forming a series of submersible gate markers 510 and submersible turn markers 520.

The skier tow boat driver steers and maintains a straight boat path 504 down the middle of all the submersible gate markers 510. The water skier is challenged to follow the skier path 505 through the second submersible gate marker 510 and back and forth outside each submersible turn marker 520.

Figure 11:
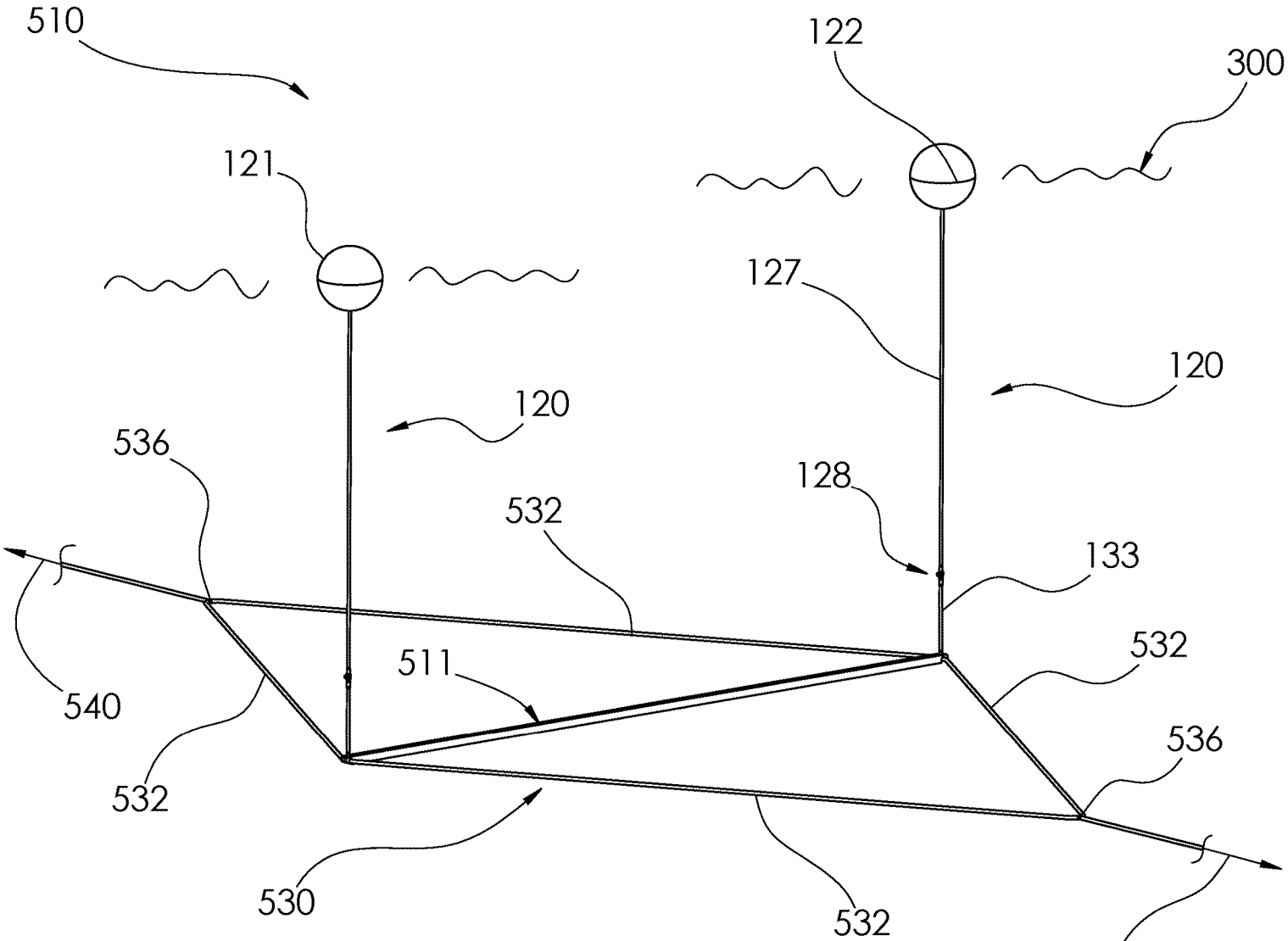
FIG. 11 is an enlarged perspective view of a submersible gate marker shown in FIG. 10.

FIG. 11 depicts an enlarged perspective view of a submersible gate marker 510. Two hose-tethered buoys 120, previously described and detailed in FIGS. 5-8, are used to deploy expanded predetermined size buoys 121 to the water surface 300. The lower ends of the hose-tethered buoys 120 are attached to the non-buoyant tension network 530 via the coupling hose 133. A rigid gate beam 511 extends between the lower ends of the hose-tethered buoys 120, establishing the required spacing between the expanded predetermined size buoys 121 at the water surface 300. The ends of the gate beam 511 also interface with the ends of the four wye hose segments 532 of the non-buoyant tension network 530. The gate beam 511 may be made of naturally non-buoyant pultruded fiberglass reinforced polyester resin material, with a solid one-inch square cross-section and an overall length of approximately ninety-two inches. The mainline tension 540 force is preferably set at about fifty pounds and can be adjusted by changing the length of the rope 503 at either end of the course. Maintaining a mainline tension 540 of fifty pounds ensures optimal stretch and straightness of the non-buoyant tension network 530 between anchor 501 and anchor 502.

Figure 12:
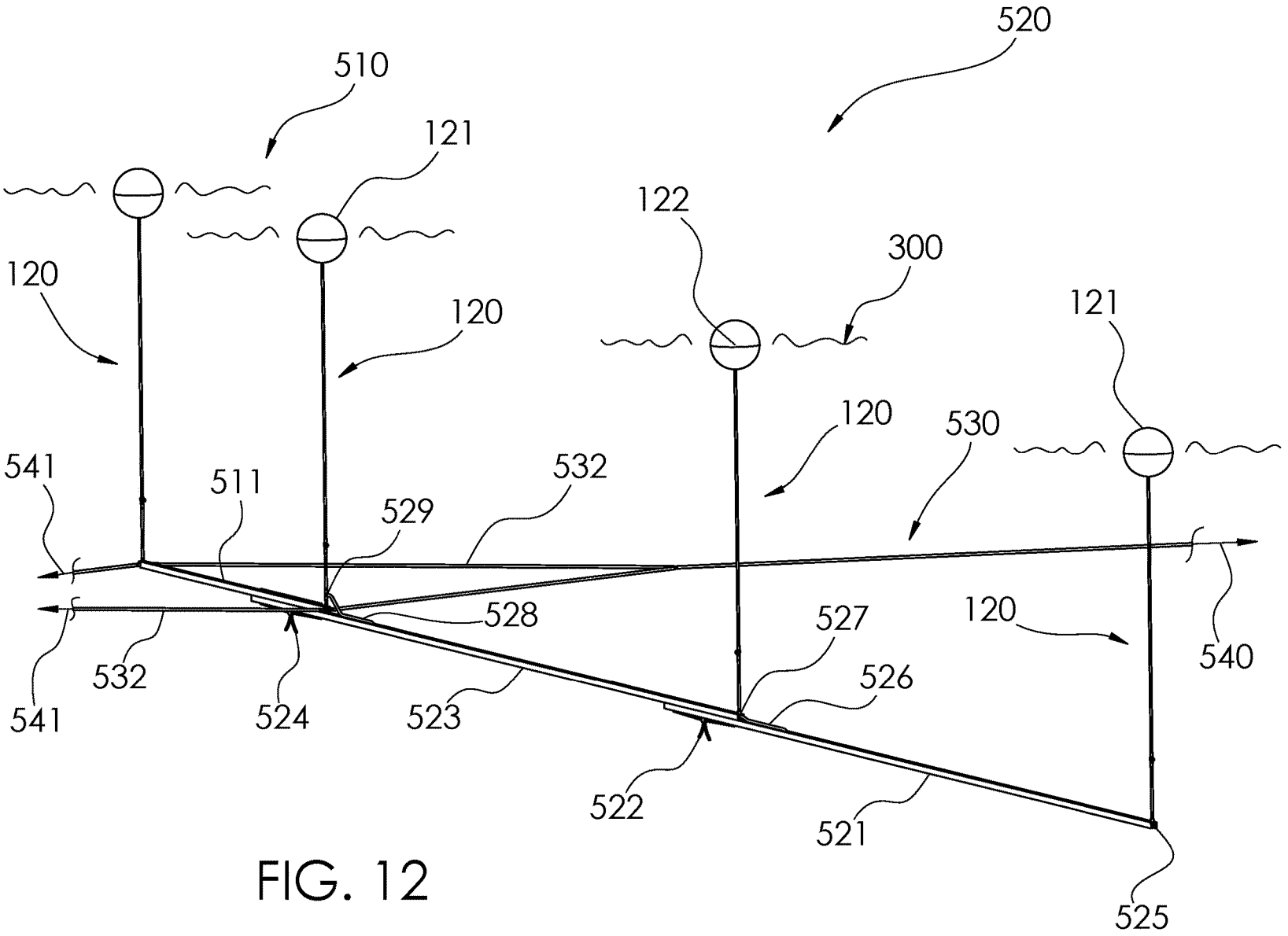
FIG. 12 is an enlarged perspective view of a submersible arm marker shown in FIG. 10.

FIG. 12 presents an enlarged perspective view of a submersible turn marker 520. The submersible turn marker 520 comprises a submersible gate marker 510 on one side and extends outward to accommodate the placement of two additional hose-tethered buoys 120, facilitated by attachment of arm beam 523 and arm beam 521. Arm beam 523 and arm beam 521 may be constructed identically from naturally non-buoyant pultruded fiberglass reinforced polyester resin material, each with a one-inch square hollow cross-section, an eighth-inch wall thickness, and an overall length of approximately 20 feet. Compared to commonly used PVC pipe, the pultruded fiberglass polyester beams are less likely to become permanently misshapen or curved while resting on uneven lake bottoms 301. Arm beam 523 is secured on one end to gate beam 511 using an elastic cord 524. The opposite end of arm beam 523 has a hole with a tee fitting 527 inserted for placement of an upper pointing barb coupled to a hose-tethered buoy 120. Arm beam 521 is secured to arm beam 523 using an elastic cord 522. The opposite end of beam 521 has a hole with an elbow fitting inserted for placement of an upper pointing barb coupled to a hose-tethered buoy 120. Outer arm hose segment 526 connects to elbow fitting 525, traverses though arm beam 521 out an opening, and is connected to tee fitting 527. Middle arm hose segment 528 is connected to tee fitting 527 and traverses through arm beam 523 out an opening, and connects to tee fitting 529. Tee fitting 529 is spliced into the coupling hose 133 of a hose-tethered buoy 120 on the submersible gate marker 510. The outer arm hose segment 526 and middle arm hose segment 528 may consist of three-sixteenths inch inside diameter by three-eighths outside diameter fiber-reinforced flexible rubber hose. Elbow fitting 525, tee fitting 527, and tee fitting 529 may be preferably made of stainless steel and may be typical barbed fittings or other types of standard or customized hose fittings. The mainline tension 540 force is preferably set at about fifty pounds and can be adjusted by changing the length of the rope 503 at either end of the course. Maintaining a mainline tension 540 of fifty pounds ensures optimal stretch and straightness of the non-buoyant tension network 530 between anchor 501 and anchor 502. The wye tension 541 force is dependent on the mainline tension force 540 and is preferably about thirty pounds.

Figure 13:
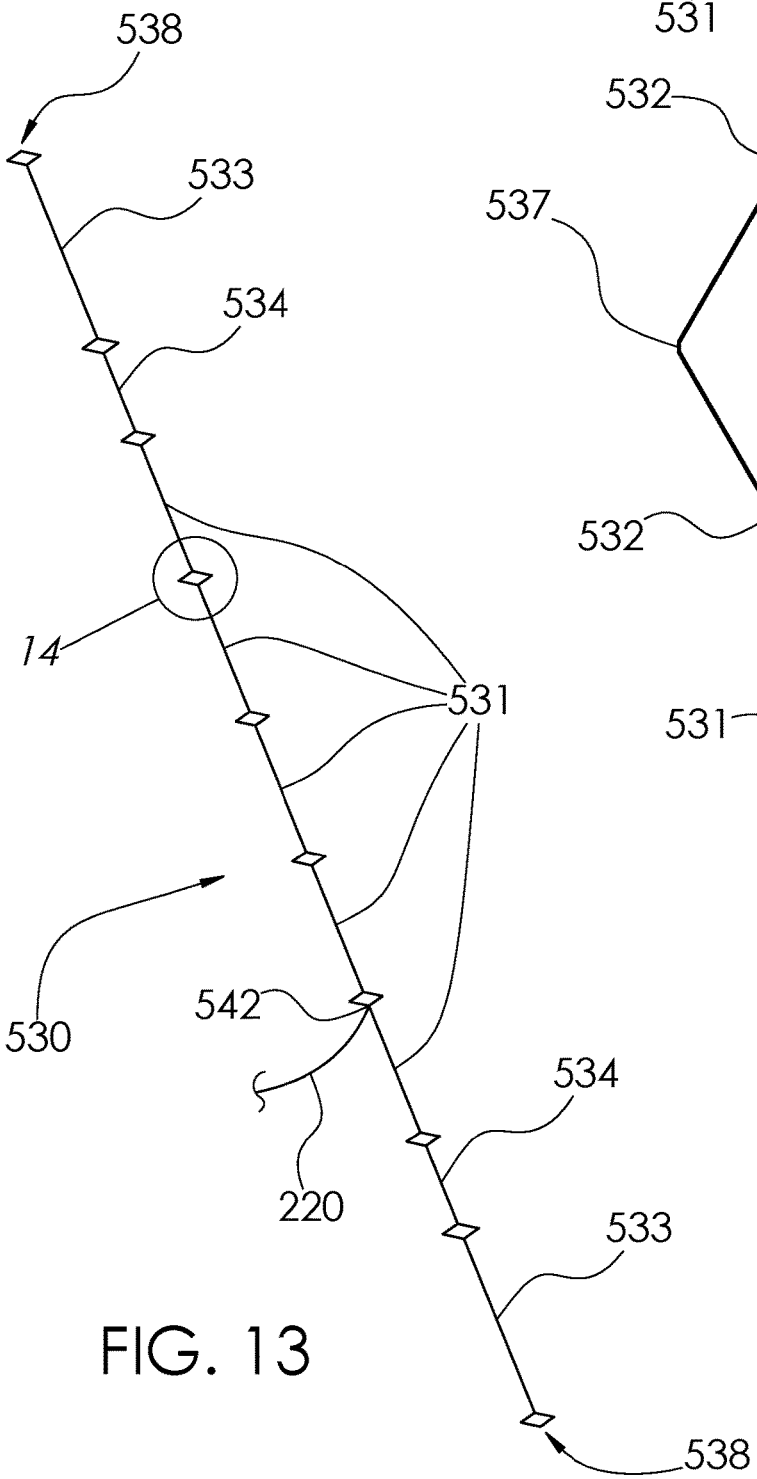
FIG. 13 is a perspective view of the non-buoyant tension network shown in FIG. 10.
Figure 14:
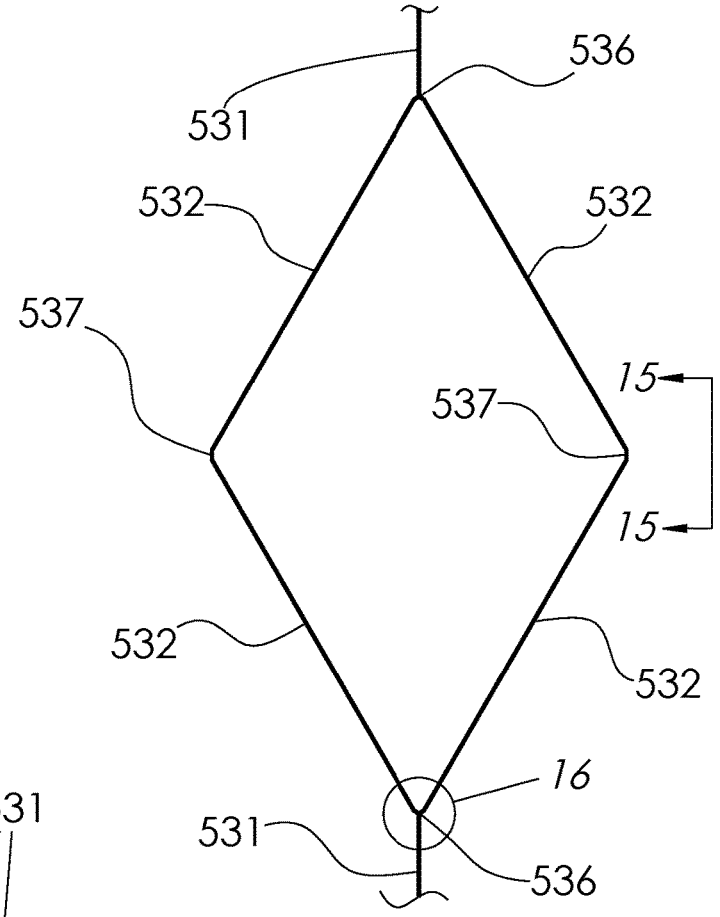
FIG. 14 is an enlarged top plan view of diamond area 14 of FIG. 13.
Figure 15:
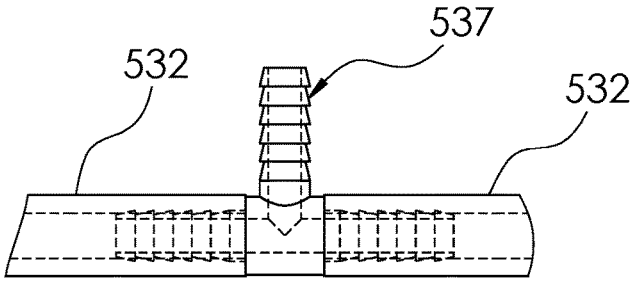
FIG. 15 is a side elevation detail view taken along line 15-15 of the diamond area shown in FIG. 14.
Figure 16:
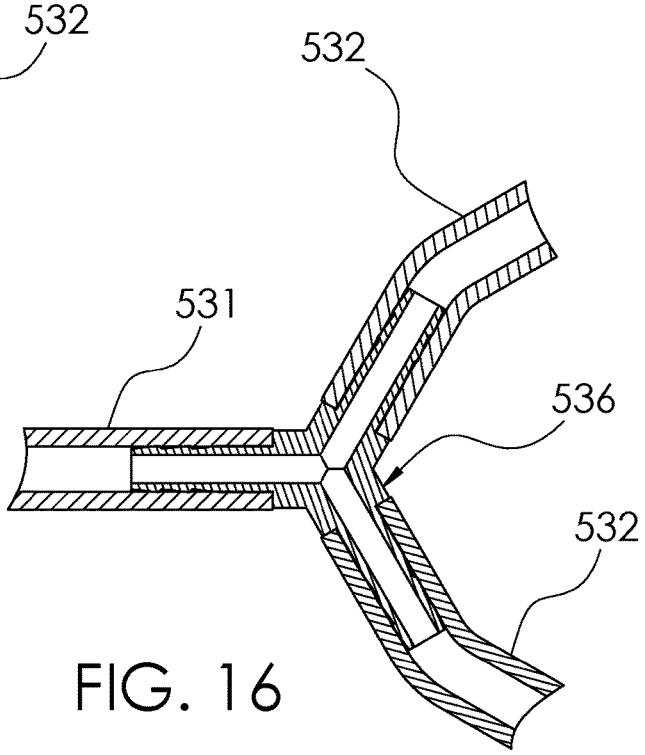
FIG. 16 is a top section detail view of area 16 of the diamond area shown in FIG. 14.
Figure 17:
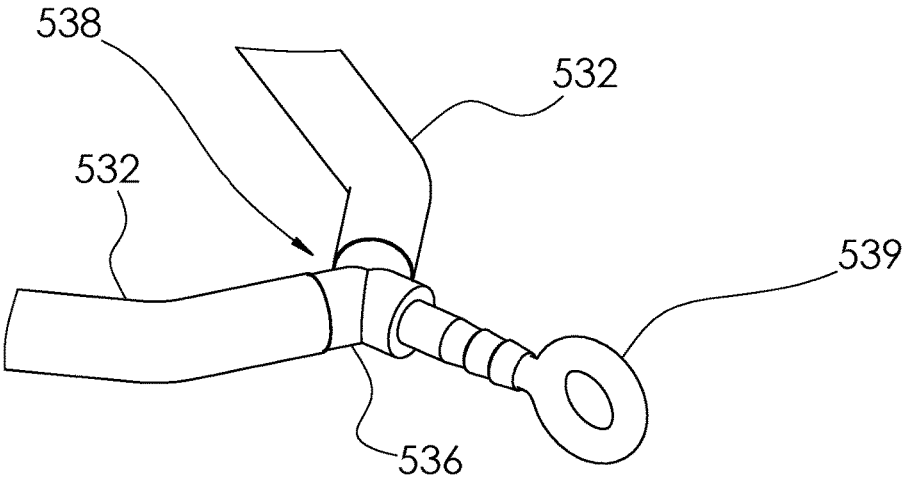
FIG. 17 is an enlarged cutaway perspective view of an anchor wye shown in FIG. 13.
Figure 18:
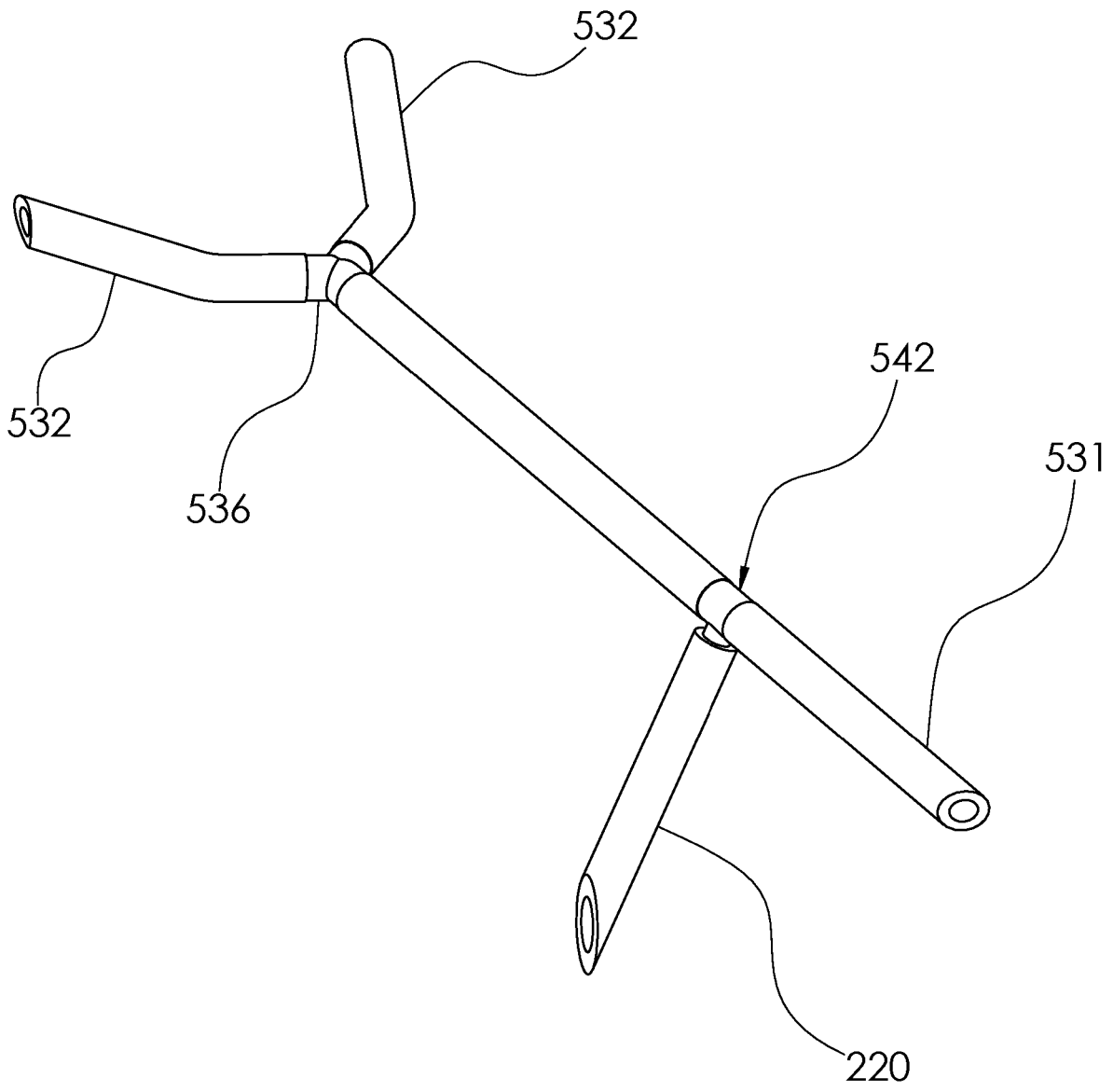
FIG. 18 is an enlarged cutaway perspective view of the non-buoyant supply line interconnection to the non-buoyant tension hose network shown in FIG. 13.

The non-buoyant tension network 530, previously shown in FIG. 10, is now further described and detailed in FIGS. 13-18. Referring to the perspective view FIG. 13, five mainline hose segments 531, two start gate hose segments 534, and two pre-gate hose segments 533 make up the majority of the non-buoyant tension network 530 length. Periodically, relatively short diamond-shaped transitions are inserted between the mainline hose segments 531, start gate hose segments 534, and pre-gate hose segments 533. On each end of the non-buoyant tension network 530, an anchor wye 538 is present for tying on rope 503. A non-buoyant supply line 220 is inserted near a diamond transition area 14 using a tee fitting 542. FIG. 14 shows an enlarged top plan view of one of the diamond transitions shown in FIG. 13. Diamond transitions are comprised of two wye fittings 536, two tee fittings 537, and four wye hose segments 532. The mainline hose segments 531, start gate hose segments 534, pre-gate hose segments 533, and wye hose segments 532 are preferably composed of hose having an outside diameter of four hundred seventy thousandths inch and an inside diameter of one quarter inch. The hose construction includes one high tensile steel wire braid with a polyurethane cover and polyester liner, providing an ideal composition for low stretch and low weight while remaining slightly non-buoyant. An alternate composition is rubber hose with five-eighths inch outside diameter and one-quarter inch inside diameter reinforced with four spirals of polyester yarn. This alternate composition has more stretch but is also ideally slightly non-buoyant and furthermore has a reinforcement which is not susceptible to corrosion. Wye fitting 536, tee fitting 537, and tee fitting 542 may be preferably composed of stainless steel and may be typical barbed fittings or other types of standard or customized hose fittings. FIG. 15 shows an enlarged side elevation view, including hidden lines taken along line 15-15 of FIG. 14, showing the upward-pointing leg of the tee fitting 537 and the connection to the wye hose segments 532. Tee fitting 537 allows air to flow through the wye hose segments 532 and through the vertical barb to a hose-tethered buoy 120. In FIG. 16, there is an enlarged top plan section view of area 16 of FIG. 14, detailing the interconnection of the mainline hose segment 531, wye fitting 536, and wye hose segments 532. Wye fitting 536 allows air to flow from the mainline hose segment 531 and in both directions to the wye hose segment 532. FIG. 17 shows an enlarged cutaway perspective view of an anchor wye 538, which is comprised of a wye fitting 536 having one leg integral with fastener 539. The other two legs of wye fitting 538 are coupled to wye hose segments 532. Finally, in FIG. 18, an enlarged perspective cutaway view of the air control 200 non-buoyant supply line 220 interconnection to a mainline hose segment 531, shown in FIG. 13, is illustrated. The non-buoyant supply line 220 is preferably located near to a wye fitting 536 and spliced into a mainline hose segment 531, or pre-gate hose segment 533, or start gate hose segment 534 with tee fitting 542.

Figure 19:
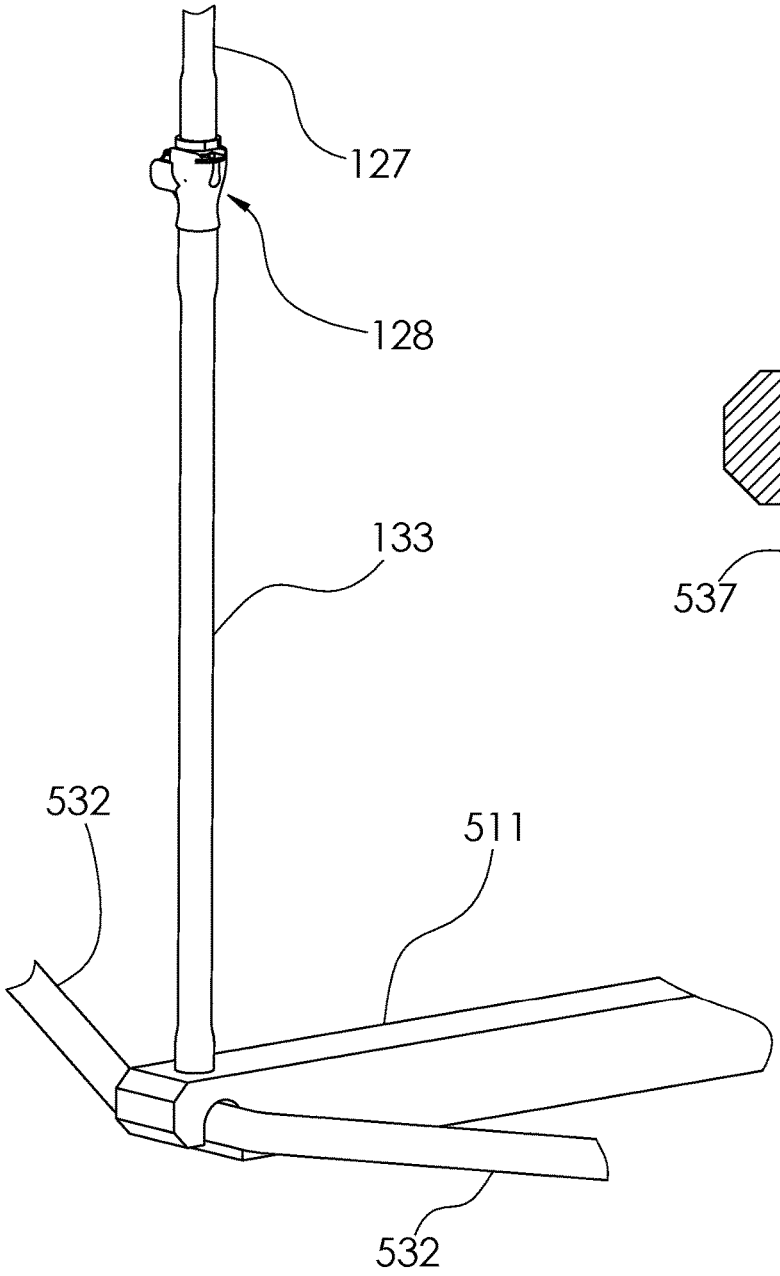
FIG. 19 is an enlarged perspective cutaway view of the lower side of the submersible gate marker shown in FIG. 11.
Figure 20:
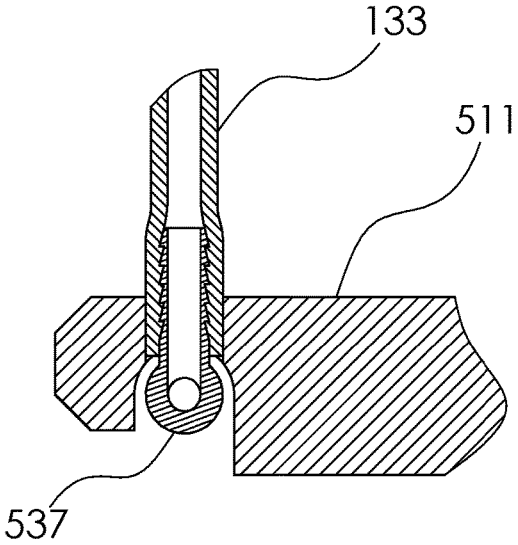
FIG. 20 is a front cross section view taken through the center of a gate beam shown in FIG. 19.

FIGS. 19-20 feature an enlarged cutaway view taken from FIG. 11, along with a corresponding section view showing one side of the submersible gate marker 510. As shown the gate beam 511 has a horizontal slot with a vertical hole that couples with the assembled shape of the tee fitting 537, wye hose segments 532, and coupling hose 133. The submersible gate marker 510 is the same on both sides.

Figure 21:
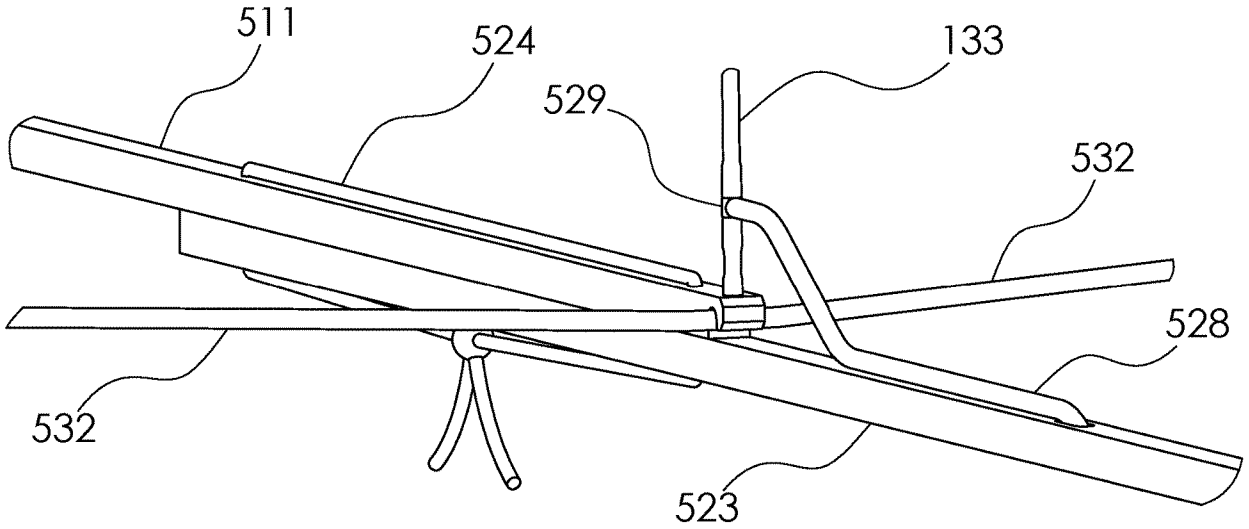
FIG. 21 is an enlarged perspective cutaway view of the lower interior submersible turn marker shown in FIG. 12.
Figure 22:
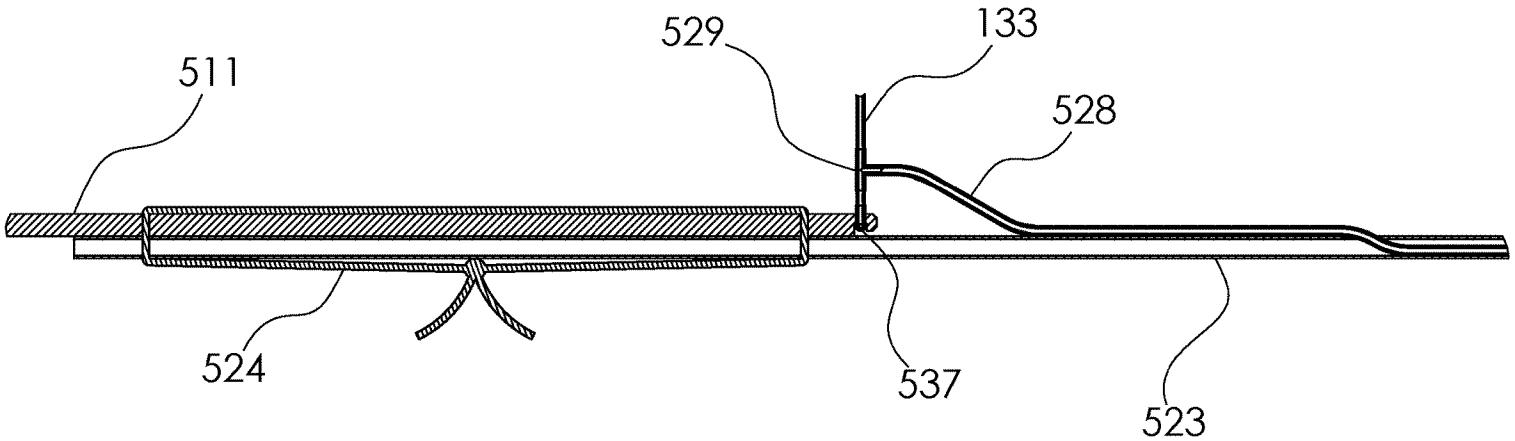
FIG. 22 is a front cross section view taken through the center of an arm beam shown in FIG. 21.
Figure 23:
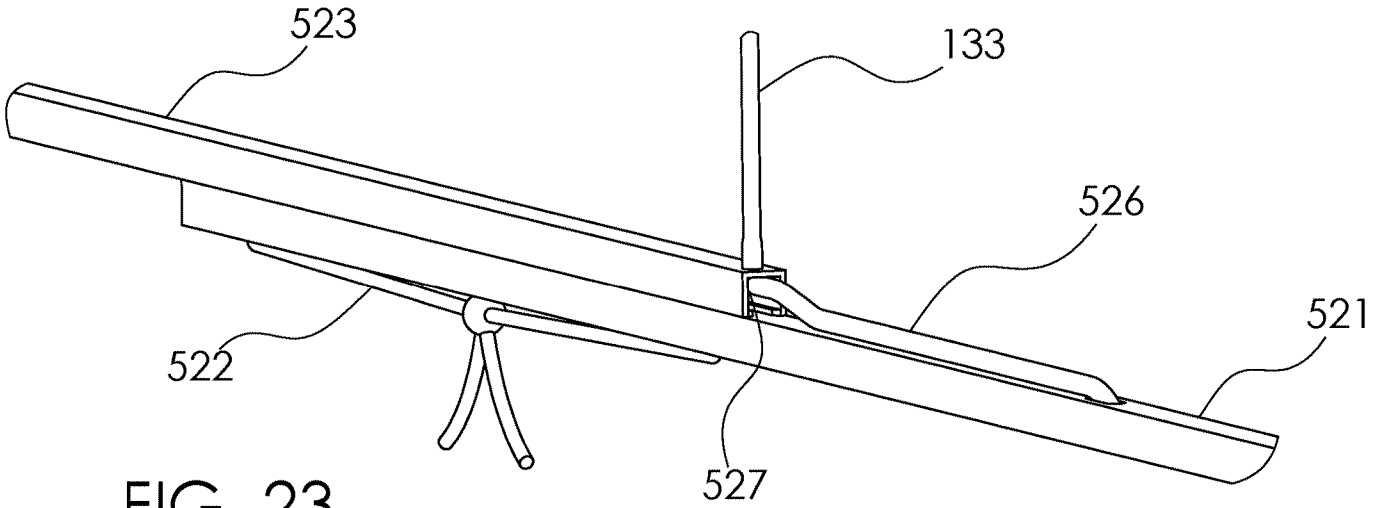
FIG. 23 is an enlarged perspective cutaway view of the lower middle submersible turn marker shown in FIG. 12.
Figure 24:
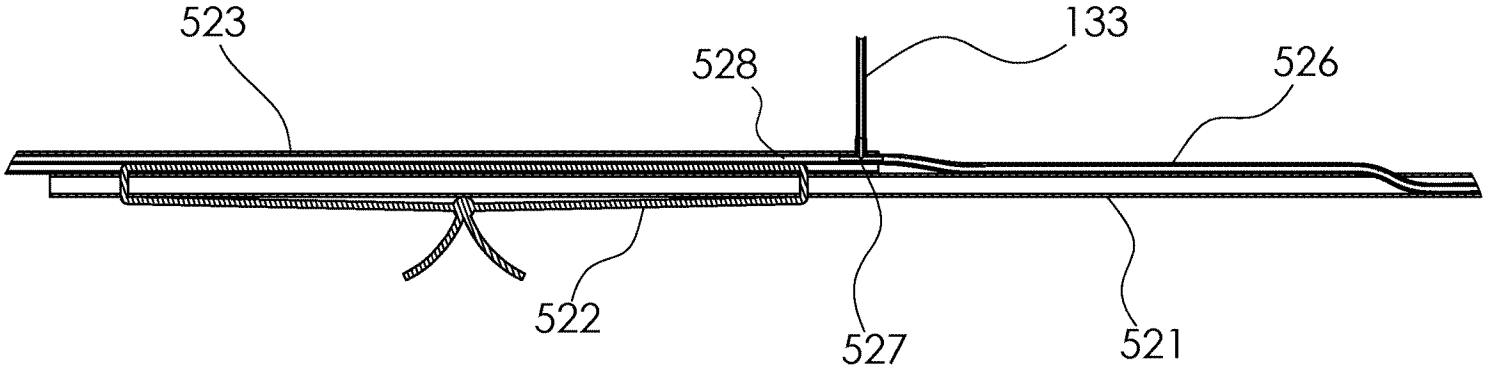
FIG. 24 is a front cross section view taken through the center of an arm beam shown in FIG. 23.

FIGS. 21-24 provide enlarged cutaway views taken from FIG. 12 along with corresponding section views illustrating additional details of the submersible gate marker 510 and submersible turn marker 520. In FIGS. 21-22, the gate beam 511 may include two vertical holes aligned with two vertical holes on one end of arm beam 523. An elastic cord 524 may be threaded through these holes, forming a loop and tied securely. The elastic cord 524 allows for relative movements between the gate beam 511 and arm beam 523 vertically, horizontally, and rotationally, while maintaining straight alignment during normal use. Air pathways are provided through the wye hose segments 532, tee fitting 537, tee fitting 529, and middle arm hose segment 528. Tee fitting 529 is spliced into the coupling hose 133 of a hose-tethered buoy 120. Additionally, arm beam 523 features a slot on the top face where middle arm hose segment 528 transitions to the interior and extends outward to the end of arm beam 523. At the opposite end of beam 523 as shown in FIGS. 23-24, the middle arm hose segment 528 is connected to tee fitting 527. The vertical leg of tee fitting 527 passes through a hole in the upper face of beam 523 and connects to the coupling hose 133 of a hose-tethered buoy 120. Arm beam 523 also includes two vertical holes on the lower face, corresponding to two vertical holes through arm beam 521. An elastic cord 522 may be looped through these holes and tied, providing for relative movements between the arm beam 523 and arm beam 521 vertically, horizontally, and rotationally, while maintaining straight alignment during normal use. The outer arm hose segment 526 is coupled to the outward pointing leg of tee fitting 527. Additionally, arm beam 521 features a slot on the top face where the outer arm hose segment 526 transitions to the interior and outward end, where it connects to elbow fitting 525.

Figure 25:
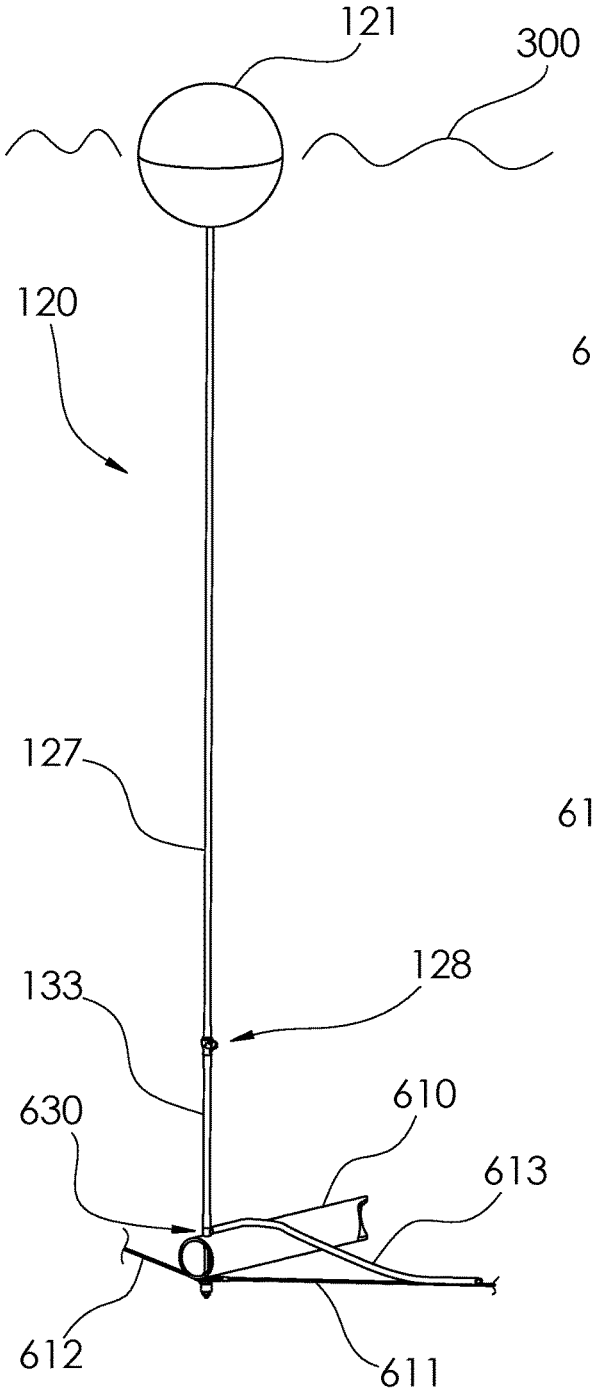
FIG. 25 is another embodiment of the present invention adapted to a conventional submersible water sports course.
Figure 26:
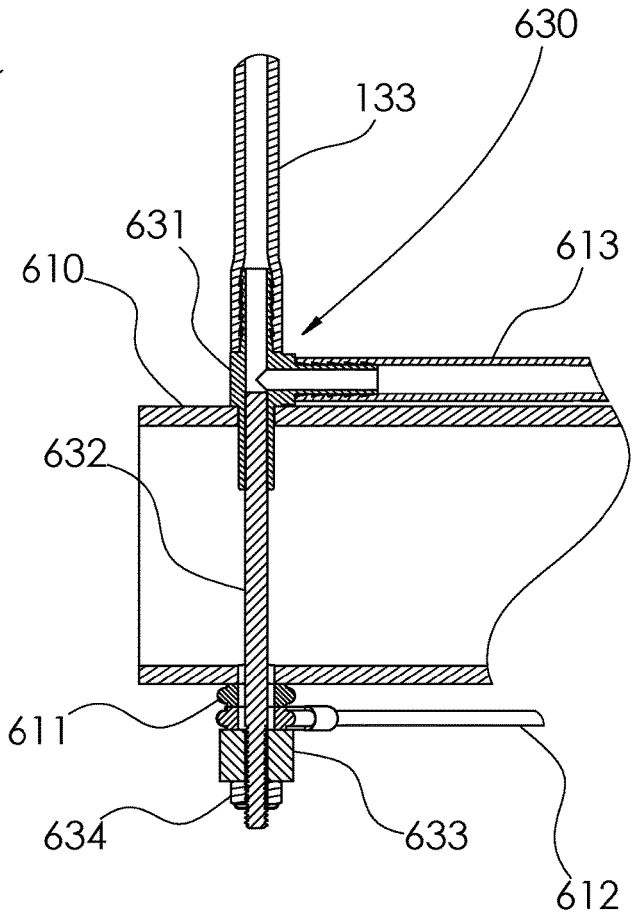
FIG. 26 is an enlarged front cross section detail view taken through the PVC pipe shown in the lower area of FIG. 25.

FIGS. 25-26 depict a perspective cutaway view and corresponding section view of an example of an alternate embodiment of the current invention, designated generally at 600. PVC pipe 610, wire rope segment 611, wire rope segment 612, and polyethylene tubing 613 are typical components described in prior art. The current invention may be applied to prior art as shown using adapter 630 and a hose-tethered buoy 120. Adapter 630 consists of a tee fitting 631, stud 632, nylon spacer 633, and lock nut 634. The stud 632 may be press fit or bonded to the downward-facing leg of tee fitting 631. The upper vertical leg of adapter 630 connects to the coupling hose 133 of the hose-tethered buoy 120, while the side facing leg connects to existing polyethylene tubing 613. The stud 632 passes through an existing vertical hole in the PVC pipe 610, and through the eyelets of the wire rope segment 611 and wire rope segment 612. The plastic spacer 633 and lock nut 634 secure the adapter 630 and the hose-tethered buoy 120 onto the water sports course. Tee fitting 631, stud 632, and locknut 634 are preferably composed of stainless steel or other non-corroding materials. Hose fittings of various types and materials may be adapted using similar methodology, falling within the scope of the current invention.

The operation of the invention is straightforward can be best described in four stages. The first stage is the 'in-use' stage, where the expanded predetermined size buoys 121 are floating at the water surface 300. During this stage, the air control 200 vacuum pressure pump 201 can be turned off, and the relief valve 207 preferably opened to the atmosphere. The expanded predetermined size buoys 121 can remain floating at the water surface 300 indefinitely without the need for additional pressurization, making them generally softer and more pliable. This enhances skier safety by allowing for more deformation at impact, thereby reducing the likelihood of serious falls. The second operating stage is the 'sinking' stage, where the air control 200 vacuum pressure pump 201 is turned on, the relief valve 207 is closed, and the quick connect socket 204 on the flexible reinforced rubber hose 205 is connected to the quick connect submerge plug 202. The vacuum pressure gauge 208 reading may immediately indicate slight vacuum conditions at the manifold 209 where the non-buoyant supply line 220 is attached and exposed to the same vacuum. The expanded predetermined size buoys 121 floating at the water surface 300 may begin to flattened out and may slowly transition into collapsed buoys 134. These collapsed buoys 134, along with the rest of the system, which is constructed entirely of non-buoyant materials, sink to the lake bottom 301. The vacuum gauge 208 reading may significantly increase when all the buoys have fully transitioned to a collapsed buoy 134 condition, serving as a helpful indicator that the sinking stage is complete. The vacuum pressure pump 201 can be turned off, and the relief valve 207 may remain closed or may be opened; either position is acceptable. The typically sinking time for an entire slalom course with thirty-two expanded predetermined size buoys 121 is about ten minutes. The third stage is the 'submerged' stage, during which the water sports course may rest indefinitely on the lake bottom 301 concealed from sight. At this stage, if the water sports course happens to be hooked by a stray boat anchor, it is nearly weightless, and may be easily pulled to the surface, untangled, and preferably released to sink undamaged back to the lake bottom 301. The fourth stage is the 'raise' stage, during which the relief valve 207 may be closed, the quick-connect socket 204 on the flexible rubber hose 205 is connected to the quick-connect raise plug 203, and the vacuum pressure pump 201 is turned on. The pressure regulator 206 maximum pressure may be set based on the water depth. For example, a system is in fifteen feet of water may have the pressure regulator set to a maximum pressure of approximately eight to ten pounds per square inch. The pressure regulator 206 maximum pressure can be monitored and adjusted by observing the vacuum pressure gauge 208 reading. The predetermined size buoys 121 slowly expand to full diameter and rise to the water surface 300. Once the expanded predetermined size buoys 121 are at the water surface 300, the vacuum pressure pump 201 can be turned off, and the relief valve 207 may be opened, completing the raise stage. The typical raise time for an entire slalom course is about eight minutes. A significant advantage of this invention is that the system may be submerged and resting on the lake bottom 301 indefinitely for months and still execute the raise stage perfectly, deploying the expanded predetermined size buoys 121 to the water surface 300 with the right size, height out of the water, and firmness, requiring no adjustments, which is virtually impossible with previous art.

The invention claimed is:

1. A hose tethered buoy for use in an automatic submersible water sports course system, comprising:

a predetermined size buoy having a soft, pliable fiber-reinforced rubber thin wall, the predetermined size buoy characterized by integration with a hose tether made of a soft, pliable, fiber-reinforced rubber, the hose tether serving as both a long tether attachment and an airline connection to the predetermined size buoy, wherein an end of the hose tether extends into an interior of the predetermined size buoy and incorporates multiple bleeder passages for airflow, the predetermined size buoy being collapsible and expandable using vacuum or pressurized air, a passage of the hose tether through the predetermined size buoy including a seal ring and a body member reinforcement having a length and a thickness allowing for sealing and fusing the hose tether to the predetermined size buoy.

2. An automatic submersible water sports course discrete anchor system for a water sports course, the anchor system comprising:

an air control operable for supplying vacuum or pressurized air;

one or more submersible markers, each comprising a hose tethered buoy with an expanded predetermined size buoy and a hose tether, and a base member including ballast and a hose fitting interconnected to the hose tether;

a network of non-buoyant hose segments interconnecting with the one or more submersible markers at each respective base members;

and a non-buoyant supply line connecting the air control to the base member;

wherein the air control supplying vacuum acts to collapse the expanded predetermined size buoys, causing the collapsed buoys to sink below a water surface, and supplying pressurized air acts to expand the collapsed buoys, causing them to rise to the water surface;

and wherein the expanded predetermined size buoys deployed to the water surface have the required relative position, size, shape, color, and height above the water surface for the water sports activity.

3. The anchor system according to claim 2, wherein the water sports course is a water ski slalom course.

4. The anchor system according to claim 2, wherein a plastic breakaway coupling is inserted between the hose tethered buoy and the base member, the breakaway coupling including a valved socket interconnected to the base member and a quick disconnect plug interconnected to the hose tethered buoy, wherein the removal of the hose tethered buoy by hand or by forceful entanglement automatically closes the socket valve preventing water entry into the network of non-buoyant hose segments.

5. A non-buoyant tension hose network for use in an automatic submersible water sports suspended tension system specifically directed to a water ski slalom course, comprising:

a plurality of flexible non-buoyant reinforced hose segments including pre-gate hose segments, a plurality of start gate hose segments, a plurality of mainline hose segments, and a plurality of wye hose segments, interconnected by wye hose fittings and tee hose fittings forming diamond shaped transitions;

wherein the outside corners of said diamond shaped transitions serve as attachment points for coupling to rigid beams and interconnecting hose tethered buoys, ensuring the stability and position of the rigid beams and hose tethered buoys; and wherein a plurality of fasteners bonded to one leg of the wye hose fittings provide a plurality of anchor rope attachment points for maintaining a position of the water ski slalom course.

6. An automatic submersible water sports course suspended tension system specifically directed to a water ski slalom course, comprising:

an air control operable for supplying vacuum or pressurized air;

a non-buoyant tension hose network extending a full length along a centerline of the water ski slalom course, suspended below a water surface and having a first tension hose network end and a second tension hose network end, the first tension hose network end tied to a proximal first rope end of a first anchor rope, and the second tension hose network end tied to a proximal second rope end of a second anchor rope;

a non-buoyant supply line connecting the air control to the non-buoyant tension hose network;

a plurality of submersible gate markers and submersible turn markers, including a plurality of hose tethered buoys and a plurality of rigid beams coupled perpendicular to the non-buoyant tension hose network;

each hose tethered buoy of the plurality of hose tethered buoys having an expanded predetermined size buoy floating at the water surface and a hose tether extending downward interconnecting to the non-buoyant tension hose network;

wherein the air control supplying vacuum acts to collapse the expanded predetermined size buoys, causing the collapsed buoys to sink below the water surface, and supplying pressurized air acts to expand the collapsed buoys, causing them to rise to the water surface;

and wherein the expanded predetermined size buoys deployed to the water surface have the required relative position, size, shape, color, and height above the water surface for the water ski slalom course.

7. The water sports course according to claim 6, wherein a plastic breakaway coupling is inserted between the each hose tethered buoy of the plurality of hose tethered buoys and the non-buoyant tension hose network, the said breakaway coupling including a valved socket interconnected to the non-buoyant tension hose network, and a quick disconnect plug interconnected to each hose tethered buoy of the plurality of hose tethered buoys, wherein the removal of one of the hose tethered buoys of the plurality of hose tethered buoys by hand or by forceful entanglement automatically closes the valved socket preventing water entry into the non-buoyant tension hose network.

8. A method for deploying a water sports buoy to a water surface comprising the acts of:

providing a hose tethered buoy with a soft and pliable predetermined size buoy and a hose tether;

providing an anchored non-buoyant hose network for interconnecting and positioning the hose tethered buoy;

providing an air control with a vacuum pressure pump, a pressure gauge, a pressure regulator, and a relief valve;

providing a non-buoyant supply line for interconnecting the air control to the anchored non-buoyant hose network;

applying regulated pressurized air to the supply line and interconnected hose tethered buoy to raise the expanded predetermined size buoy to the water surface;

and releasing the pressurized air to the supply line and interconnected hose tethered buoy to provide a soft and pliable expanded predetermined size buoy floating at the water surface.

9. A method for submerging a water sports buoy below a water surface comprising the acts of:

providing a hose tethered buoy with a soft and pliable predetermined size buoy and a hose tether;

providing an anchored non-buoyant hose network for interconnecting and positioning the hose tethered buoy;

providing an air control with a vacuum pressure pump, a pressure gauge, a pressure regulator, and a relief valve;

providing a non-buoyant supply line for interconnecting the air control to the anchored non-buoyant hose network;

applying vacuum to the supply line and interconnected hose tethered buoy to collapse the expanded predetermined size buoy floating at the water surface and thereby submerge the collapsed buoy below the water surface;

and releasing the vacuum to the supply line and interconnected hose tethered buoy, wherein the collapsed buoy remains submerged below the water surface.

* * * * *